US010236652B2

(12) United States Patent
Saito et al.

(10) Patent No.: US 10,236,652 B2
(45) Date of Patent: Mar. 19, 2019

(54) TERMINAL-EQUIPPED ELECTRIC WIRE, TERMINAL CRIMPING APPARATUS, AND METHOD OF MANUFACTURING TERMINAL-EQUIPPED ELECTRIC WIRE

(71) Applicant: Yazaki Corporation, Tokyo (JP)

(72) Inventors: Hideki Saito, Shizuoka (JP); Hirotaka Takeda, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/029,710

(22) Filed: Jul. 9, 2018

(65) Prior Publication Data

US 2019/0020163 A1 Jan. 17, 2019

(30) Foreign Application Priority Data

Jul. 11, 2017 (JP) ..... 2017-135452

(51) Int. Cl.

| | |
|---|---|
| ***H01R 11/30*** | (2006.01) |
| ***H01R 43/048*** | (2006.01) |
| ***H01R 43/058*** | (2006.01) |
| ***H01R 4/18*** | (2006.01) |

(52) U.S. Cl.

CPC ..... *H01R 43/048* (2013.01); *H01R 4/185* (2013.01); *H01R 4/188* (2013.01); *H01R 43/058* (2013.01)

(58) Field of Classification Search

CPC .... H01R 13/6205; H01R 13/24; H01R 11/30; H01R 13/6271; H01R 13/665; H01R 13/64; H01R 4/62; H01R 4/185; H01R 13/5216; H01R 4/206; H01R 4/70

USPC ..... 439/39

See application file for complete search history.

(56) References Cited

U.S. PATENT DOCUMENTS

| | | | | |
|---|---|---|---|---|
| 5,671,528 | A | 9/1997 | Endo et al. | |
| 5,901,439 | A | 5/1999 | Endo et al. | |
| 9,774,099 | B2 * | 9/2017 | Aoki | H01R 4/62 |
| 2002/0027013 | A1 * | 3/2002 | Kondo | H01R 4/70 174/110 R |
| 2013/0130569 | A1 * | 5/2013 | Sato | H01R 4/206 439/882 |
| 2015/0357722 | A1 * | 12/2015 | Sato | H01R 13/5216 439/877 |
| 2016/0006164 | A1 * | 1/2016 | Sato | H01R 4/185 439/587 |

(Continued)

FOREIGN PATENT DOCUMENTS

| | | |
|---|---|---|
| JP | 8-222343 A | 8/1996 |
| JP | 2009-301839 A | 12/2009 |

(Continued)

*Primary Examiner* — Jean F Duverne

(74) *Attorney, Agent, or Firm* — Kenealy Vaidya LLP

(57) ABSTRACT

An electric wire connection portion of a crimp terminal includes a core wire crimping portion crimped to a core wire at an end of an electric wire, a bottom of the core wire crimping portion includes a recess, formed by causing a part of a supported surface on an outer wall surface side to be recessed to an inner wall surface side and a protrusion protruding from the inner wall surface toward the core wire at the end of the electric wire by the recess of the recess, and ends of the recess and the protrusion on a side opposite to the sheath crimping portion side are inclined to the sheath crimping portion side as being directed from the outer wall surface side to the inner wall surface side.

5 Claims, 16 Drawing Sheets

(56) References Cited

U.S. PATENT DOCUMENTS

| | | | |
|---|---|---|---|
| 2016/0359245 | A1 | 12/2016 | Aoki et al. |
| 2017/0331202 | A1 | 11/2017 | Aoki et al. |

FOREIGN PATENT DOCUMENTS

| | | | |
|---|---|---|---|
| JP | 2010-015915 | A | 1/2010 |
| JP | 2015-179635 | A | 10/2015 |
| JP | 2016-105425 | A | 6/2016 |

* cited by examiner

TERMINAL-EQUIPPED ELECTRIC WIRE, TERMINAL CRIMPING APPARATUS, AND METHOD OF MANUFACTURING TERMINAL-EQUIPPED ELECTRIC WIRE

CROSS-REFERENCE TO RELATED APPLICATION(S)

The present application claims priority to and incorporates by reference the entire contents of Japanese Patent Application No. 2017-135452 filed in Japan on Jul. 11, 2017.

BACKGROUND OF THE INVENTION

1. Field of the Invention

The present invention relates to a terminal-equipped electric wire, a terminal crimping apparatus, and a method of manufacturing a terminal-equipped electric wire.

2. Description of the Related Art

Conventionally, a crimp terminal including an electric wire connection portion to be electrically connected to an electric wire has been known. The electric wire connection portion is partitioned into a bottom and two barrel pieces at both ends of the bottom, and encloses the electric wire with the two barrel pieces while being sandwiched between a first mold and a second mold approaching each other, thereby being crimped onto the electric wire. Upon crimping, the electric wire connection portion is caulked to the electric wire in a state where the bottom is supported by a support surface of the first mold and the two barrel pieces are pressed by a pressing surface of the second mold. The crimp terminal and the electric wire become the terminal-equipped electric wire by finishing the crimping processing. In the terminal-equipped electric wire, an electric wire is drawn out from an end of the electric wire connection portion. This type of terminal-equipped electric wire is disclosed, for example, in Japanese Patent Application Laid-open No. 2015-179635, Japanese Patent Application Laid-open No. 2010-15915, Japanese Patent Application Laid-open No. 2009-301839, Japanese Patent Application Laid-open No. H8-222343, and Japanese Patent Application Laid-open No. 2016-105425.

Meanwhile, there is a possibility that the electric wire connection portion extends in its own axial direction (that is, a drawing-out direction of the electric wire) when being pressed between the first mold and the second mold. In addition, when the entire bottom of the electric wire connection portion is not supported by the support surface of the first mold, there is a possibility that such an unsupported part of the bottom sticks out toward a pressing direction due to the pressure from the second mold. That is, there is a possibility that a size of the electric wire connection portion is increased in a terminal-equipped electric wire of the related art.

SUMMARY OF THE INVENTION

Therefore, a purpose of the present invention is to provide a terminal-equipped electric wire, a terminal crimping apparatus, and a method of manufacturing a terminal-equipped electric wire that can suppress an increase in size.

According to one aspect of the present invention, a terminal-equipped electric wire includes an electric wire having a core wire bare at an end thereof, and a crimp terminal physically and electrically connected to the core wire by being crimped to the end of the electric wire. The crimp terminal includes an electric wire connection portion that has a bottom having a placement surface on an inner wall surface side on which the end of the electric wire is placed and a supported surface on an outer wall surface side, and a pair of barrel pieces that extends from both ends of the bottom in a width direction and is wound around the end of the electric wire. The electric wire connection portion includes a core wire crimping portion in which the bottom and the pair of barrel pieces are crimped to the core wire at the end of the electric wire and a sheath crimping portion in which the bottom and the pair of barrel pieces are crimped to a sheath at the end of the electric wire. The bottom of the core wire crimping portion includes a recess, formed by causing a part of the supported surface to be recessed to the inner wall surface side, and a protrusion formed to protrude from the inner wall surface toward the core wire at the end of the electric wire as the recess is recessed. Ends of the recess and the protrusion on a side opposite to the sheath crimping portion side are inclined to the sheath crimping portion side as being directed from the outer wall surface side to the inner wall surface side.

According to another aspect of the present invention, in the terminal-equipped electric wire, the recess and the protrusion are extended along a drawing direction of the electric wire from the crimp terminal.

According to still another aspect of the present invention, in the terminal-equipped electric wire, the end of the protrusion on the side opposite to the sheath crimping portion side includes a serration recessed toward the recess.

According to still another aspect of the present invention, a terminal crimping apparatus includes a first mold that supports a supported surface on an outer wall surface side of a bottom of a crimp terminal having the bottom and a pair of barrel pieces, and a second mold that winds the pair of barrel pieces around an end of an electric wire while shortening a distance with respect to the first mold in a state where the end of the electric wire is inserted into a space surrounded by the bottom and the pair of barrel pieces to form a core wire crimping portion crimped to a core wire bare at the end of the electric wire and a sheath crimping portion crimped to a sheath at the end of the electric wire. The first mold includes a first support surface supporting the supported surface of the bottom of the core wire crimping portion, a second support surface supporting the supported surface of the bottom of the sheath crimping portion, and a convex pressing portion protruding from the first support surface toward the second mold. The convex pressing portion is inserted into a recess in which a part of the supported surface at the bottom of the core wire crimping portion is recessed to an inner wall surface side of the bottom to press and deform a wall surface of the recess while shortening a distance with respect to the second mold so that a protrusion protruding from the inner wall surface toward the core wire at the end of the electric wire is formed in the bottom of the core wire crimping portion. An end of the convex pressing portion on a side opposite to the second support surface side is inclined to the second support surface side as being directed toward a protruding direction of the convex pressing portion, and each end of the recess and the protrusion on a side opposite to the sheath crimping portion side is inclined to the sheath crimping portion side as being directed from the outer wall surface side to the inner wall surface side when the recess and the protrusion are formed.

According to still another aspect of the present invention, a method of manufacturing a terminal-equipped electric wire, includes a terminal support step of supporting a supported surface on an outer wall surface side of a bottom of a crimp terminal having the bottom and a pair of barrel pieces using a first mold, and a crimping step of winding the pair of barrel pieces around an end of an electric wire while shortening a distance between the first mold and a second mold in a state where the end of the electric wire is inserted into a space surrounded by the bottom and the pair of barrel pieces to form a core wire crimping portion crimped to the core wire bare at the end of the electric wire and a sheath crimping portion crimped to a sheath at the end of the electric wire. In the terminal support step, the supported surface of the bottom of the core wire crimping portion is supported by a first support surface of the first mold, the supported surface of the bottom of the sheath crimping portion is supported by a second support surface of the first mold, and a convex pressing portion protruding from the first support surface toward the second mold is inserted into a recess in which a part of the supported surface at the bottom of the core wire crimping portion is recessed to an inner wall surface side of the bottom when the supported surface of the bottom of the core wire crimping portion is supported by the first support surface. In the crimping step, a wall surface of the recess is pressed and deformed by the convex pressing portion while crimping the pair of barrel pieces with respect to the end of the electric wire to form a protrusion protruding from the inner wall surface toward the core wire at the end of the electric wire in the bottom of the core wire crimping portion. In the crimping step, each end of the recess and the protrusion on a side opposite to the sheath crimping portion side is inclined to the sheath crimping portion side as being directed from the outer wall surface side to the inner wall surface side by pressing a wall surface of the recess with the convex pressing portion having an end on a side opposite to the second support surface side inclined to the second support surface side as being directed toward a protruding direction of the convex pressing portion when the recess and the protrusion are formed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of a terminal-equipped electric wire, a terminal crimping apparatus, and a method of manufacturing a terminal-equipped electric wire according to the present invention will be described in detail with reference to the drawings. Incidentally, the invention is not limited by the embodiments.

Embodiment

One of the embodiments of the terminal-equipped electric wire, the terminal crimping apparatus, and the method of manufacturing a terminal-equipped electric wire according to the present invention will be described with reference to FIGS. 1 to 22.

Figure 1:
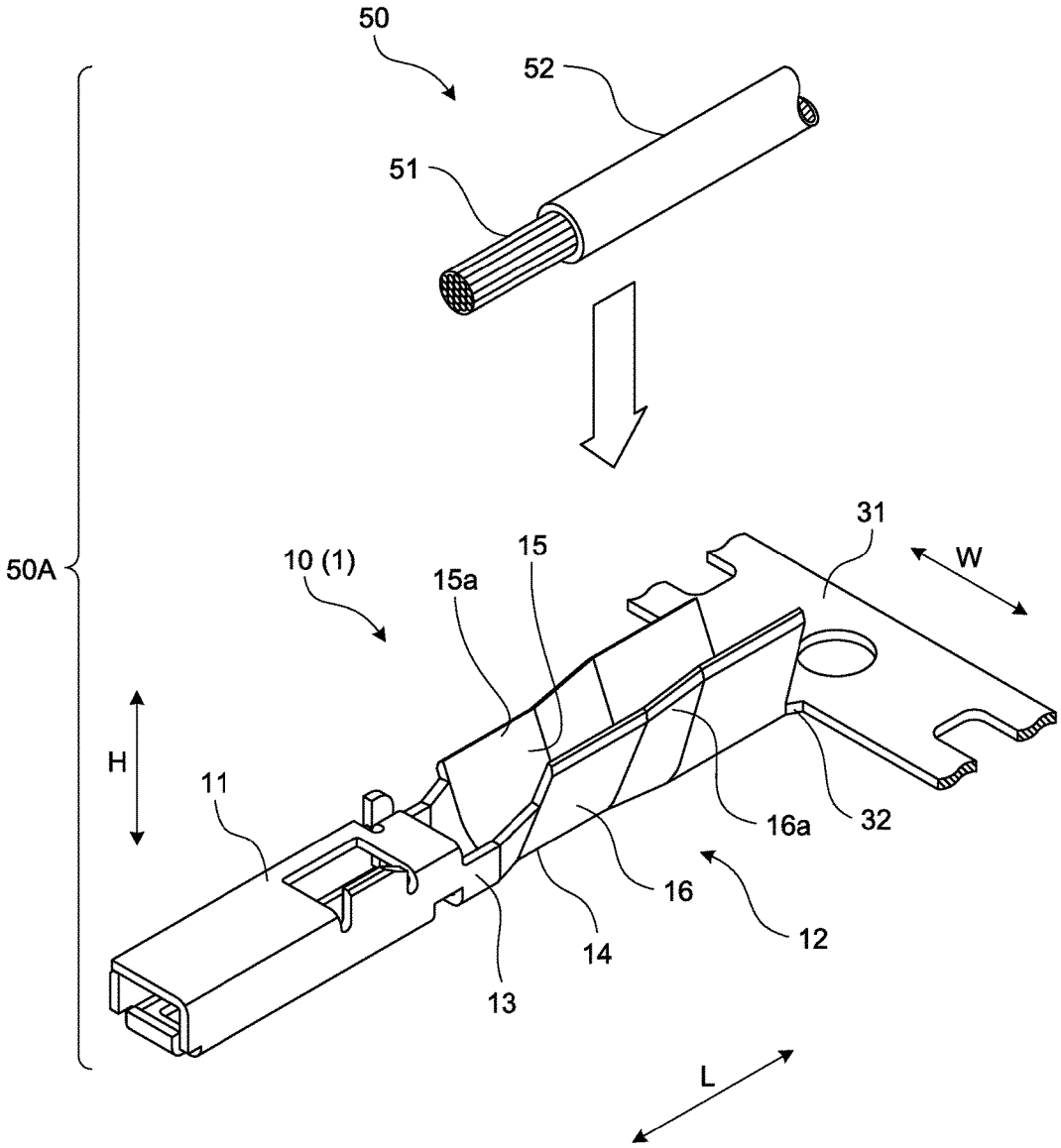
FIG. 1 is a perspective view illustrating a terminal-equipped electric wire before completion of crimping according to an embodiment.

Reference numeral 1 in FIGS. 1 to 8 represents a crimp terminal according to the present embodiment. The crimp terminal 1 is electrically connected to an electric wire 50 (FIGS. 1 and 3 to 6), and is electrically connected to a counterpart terminal (not illustrated) in the state of being integrated with the electric wire 50. Here, a core wire 51 is bare at an end of the electric wire 50 (FIG. 1). In order to expose the core wire 51 by a predetermined length, a sheath 52 at the end of the electric wire 50 is peeled off and removed, for example, by a length corresponding to the predetermined length. The core wire 51 may be an aggregate of a plurality of strands or may be a single wire such as a coaxial cable. As being crimped to the end of the electric wire 50, the crimp terminal 1 is physically and electrically connected to the bare core wire 51. The connection between the crimp terminal 1 and the end of the electric wire 50 is obtained by crimping processing between support portions (a first support surface 112$A_1$ and a second support surface 112$B_1$) of a first mold 112 and pressing portions (a core wire pressing portion 113$A_1$ and a sheath pressing portion 113$B_1$) of a second mold 113 to be described later. Hereinafter, a coupler of the crimp terminal 1 and the electric wire 50 illustrated in FIGS. 3 to 6 will be referred to as a "terminal-equipped electric wire 50A".

The crimp terminal 1 includes at least a terminal fitting 10 (FIGS. 1 to 8). In the present embodiment, a description will be given by exemplifying the crimp terminal including only the terminal fitting 10, but the crimp terminal 1 may be provided with a water stop member 20 as illustrated in FIG. 9, for example. The water stop member 20 is a member for stopping water so as not to bring a liquid such as water into contact with the core wire 51 after completion of the crimping processing (hereinafter referred to as "after completion of crimping"). The water stop member 20 is pasted to the terminal fitting 10 and deforms along with the crimping processing of the crimp terminal 1 with respect to the electric wire 50 to cover the periphery of the bare core wire 51. In addition, due to such a deformation, the water stop member 20 is also interposed between a first barrel piece 15 and a second barrel piece 16 in an overlapping area to be described later.

The terminal fitting 10 is the main body part of the crimp terminal 1. The terminal fitting 10 is molded using a conductive material such as metal. Here, a conductive metal plate (for example, a copper plate) is used as a base material, and this base material is formed into a predetermined shape capable of being connected to the counterpart terminal and the electric wire 50 by press molding. As illustrated in FIGS. 1 to 9, the terminal fitting 10 includes a terminal connection portion 11 electrically connected to the counterpart terminal, an electric wire connection portion 12 electrically connected to the end of the electric wire 50. The terminal connection portion 11 and the electric wire connection portion 12 are coupled by a coupling portion 13 interposed therebetween.

The terminal fitting 10 may be a male terminal or a female terminal. The terminal connection portion 11 is formed in a male type when the terminal fitting 10 is the male terminal, and is formed in a female type when the terminal fitting 10 is the female terminal. The present embodiment will be described by exemplifying the female terminal.

Here, in this crimp terminal 1, an insertion and extraction direction (a connection direction and a separation direction) with respect to the counterpart terminal is defined as a longitudinal direction, and this longitudinal direction is defined as a first direction L. In addition, a direction along the plane of the base material before press molding among directions orthogonal to the first direction L is defined as a width direction, and this width direction is defined as a second direction W in the crimp terminal 1. The second direction W is also a parallel arrangement direction of the crimp terminal 1 to be described later. In addition, in the crimp terminal 1, a direction orthogonal to each of the first direction L and the second direction W is defined as a height direction, and this height direction is defined as a third direction H.

First, the electric wire connection portion 12 is formed into a single plate shape (FIGS. 7 and 8), and is formed in a U-shape as a state immediately before connection with the electric wire 50 (FIG. 1). The electric wire connection portion 12 formed in the U-shape is crimped to the end of the electric wire 50 by being wound around the electric wire 50 in a state where the end of the electric wire 50 is placed on an inner wall surface side of the electric wire connection portion 12, thereby being brought into contact with the bare core wire 51. The electric wire connection portion 12 is electrically connected to the core wire 51 at the end of the electric wire 50 along with the crimping processing on the end of the electric wire 50 placed on the inner wall surface side as described above. As will be described later, the electric wire connection portion 12 has a bottom 14 and the pair of barrel pieces (the first barrel piece 15 and the second barrel piece 16), and the pair of barrel pieces is wound around the end of the electric wire 50 placed on the bottom 14. The pair of barrel pieces is wound around the end of the electric wires 50 to overlap each other.

The electric wire connection portion 12 has a core wire crimping portion 12A and a sheath crimping portion 12B (FIGS. 2 to 9). The electric wire connection portion 12 can be partitioned into an area of the core wire crimping portion 12A and an area of the sheath crimping portion 12B in the first direction L. The core wire crimping portion 12A is a part that is crimped to the bare core wire 51 in the end of the electric wire 50 to be crimped. A part that corresponds to the core wire crimping portion 12A in the bottom 14 and the pair of barrel pieces (the first barrel piece 15 and the second barrel piece 16) to be described later is crimped to the core wire 51. The core wire crimping portion 12A is connected to the coupling portion 13. The sheath crimping portion 12B is a part that is crimped to the sheath 52 in the end of the electric wire 50 to be crimped. A part that corresponds to the sheath crimping portion 12B in the bottom 14 and the pair of barrel pieces is crimped to the sheath 52.

Figure 8:
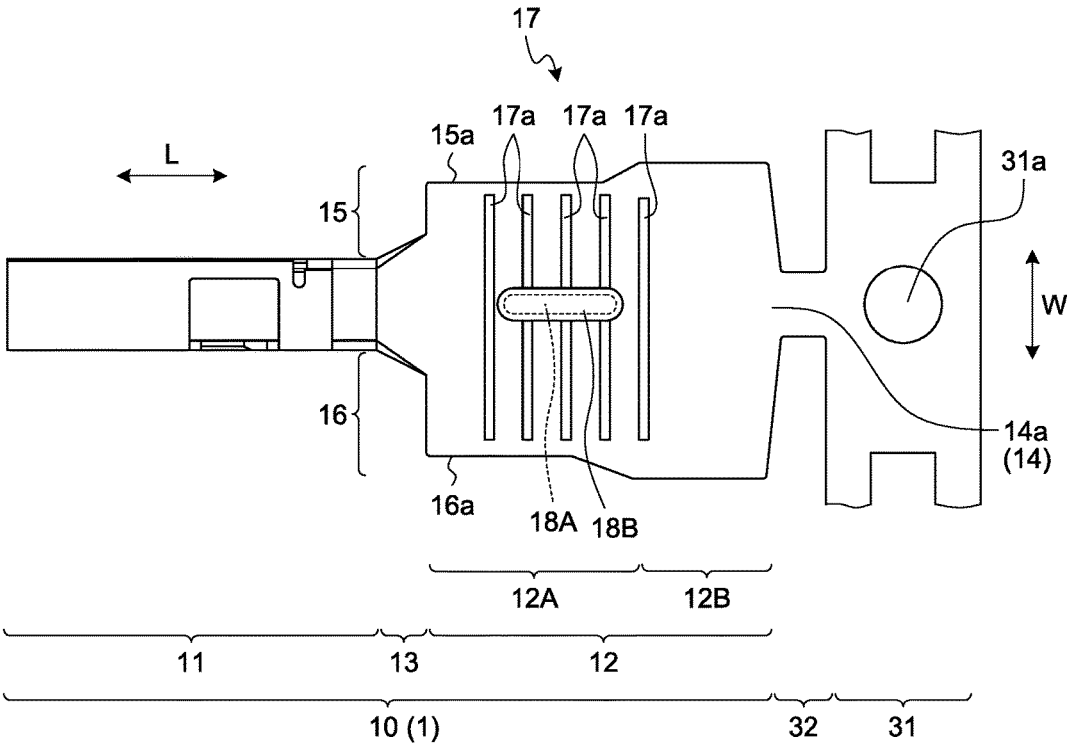
FIG. 8 is a top view illustrating the crimp terminal before the electric wire connection portion is formed in the U-shape.
Figure 9:
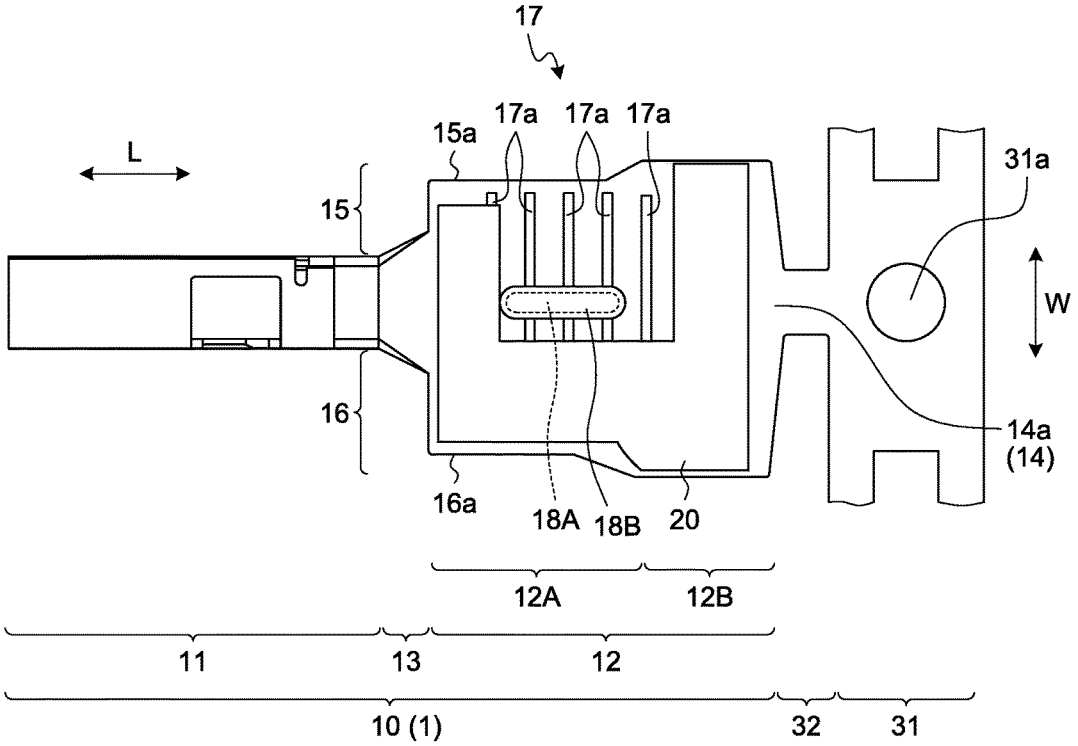
FIG. 9 is a top view illustrating another aspect of the crimp terminal before the electric wire connection portion is formed in the U-shape.

Further, the electric wire connection portion 12 has the bottom 14 and the pair of barrel pieces (the area of the first barrel piece 15 and the second barrel piece 16) (FIGS. 1 and 8 to 9). The electric wire connection portion 12 can be partitioned into an area of the bottom 14, an area of the first barrel piece 15, and an area of the second barrel piece 16 in the second direction W. During the crimping processing, the electric wire connection portion 12 allows the end of the electric wire to be inserted into a U-shaped inner space surrounded by the bottom 14 and the pair of barrel pieces.

Figure 2:
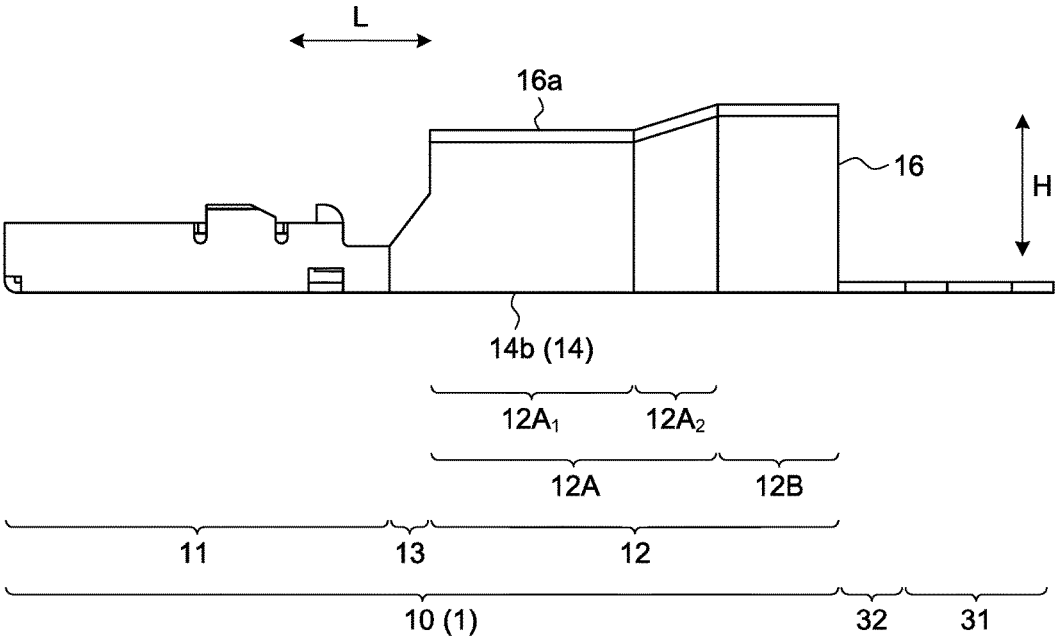
FIG. 2 is a side view illustrating a crimp terminal according to the embodiment and illustrates a state where an electric wire connection portion is formed in a U-shape.
Figure 3:
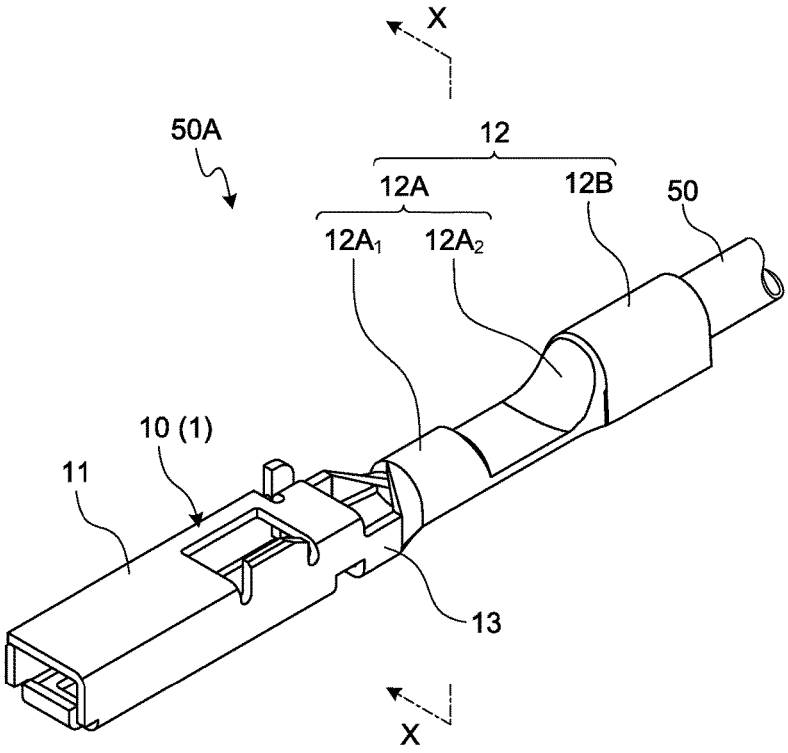
FIG. 3 is a perspective view illustrating a terminal-equipped electric wire after completion of crimping according to an embodiment.
Figure 4:
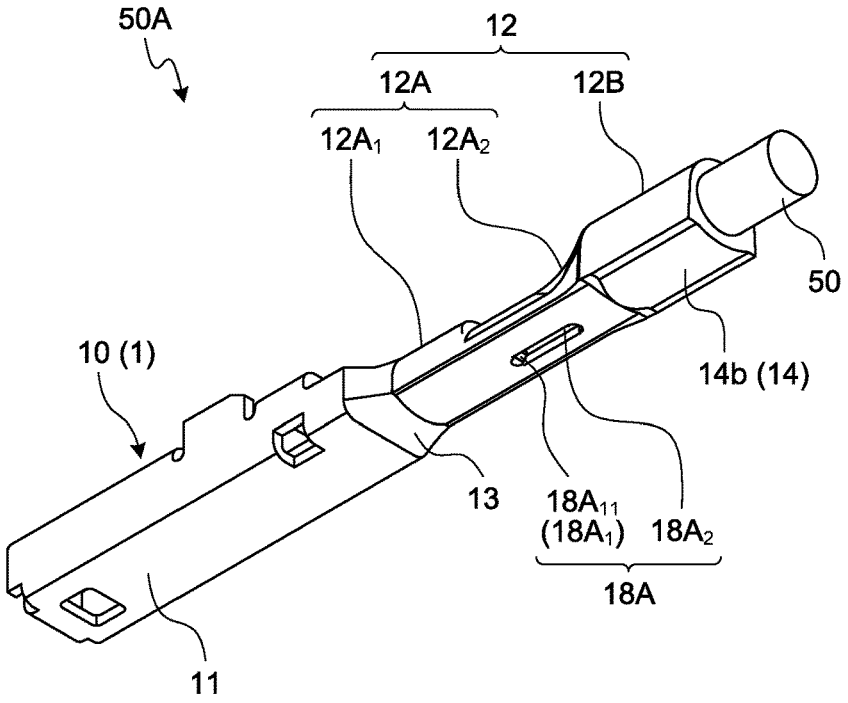
FIG. 4 is a perspective view of the terminal-equipped electric wire after completion of crimping according to the embodiment as viewed from another angle.
Figure 5:
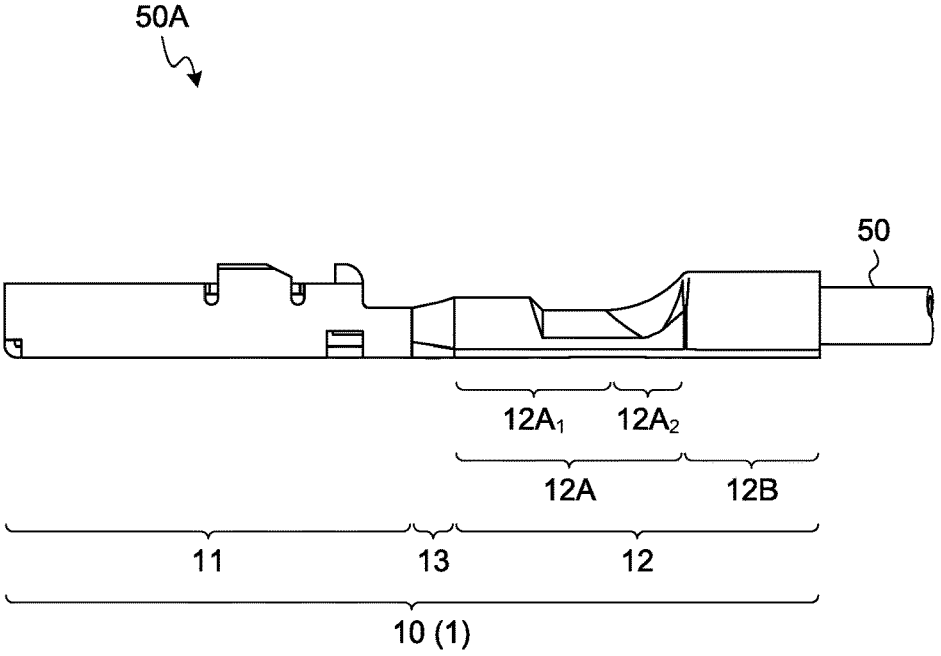
FIG. 5 is a side view illustrating the terminal-equipped electric wire after completion of crimping according to the embodiment.
Figure 6:
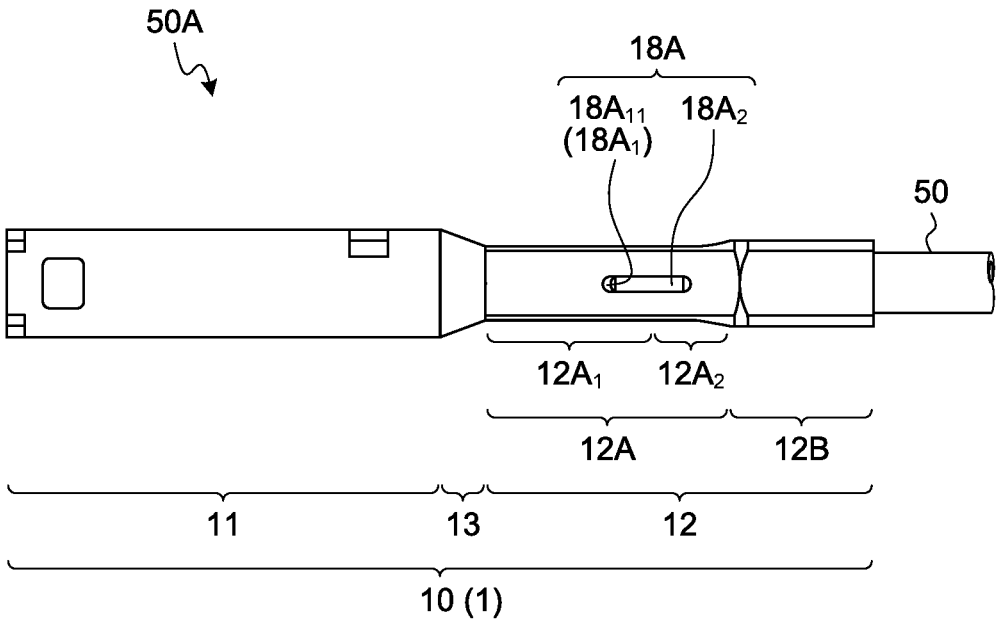
FIG. 6 is a bottom view illustrating the terminal-equipped electric wire after completion of crimping according to the embodiment.
Figure 10:
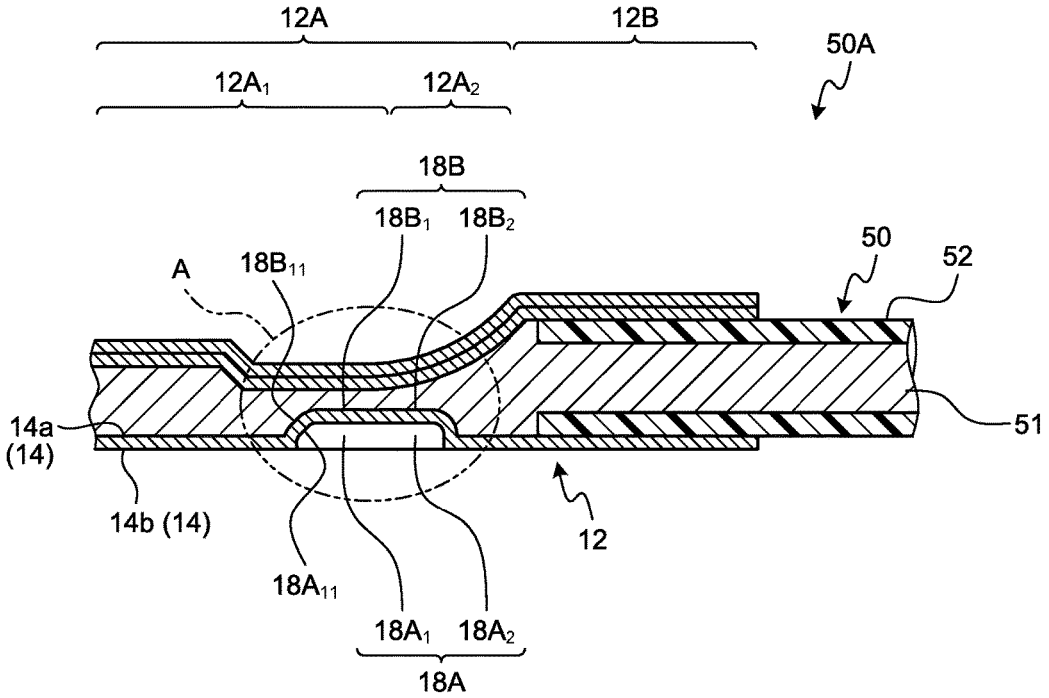
FIG. 10 is a cross-sectional view of the electric wire connection portion taken along a line X-X in FIG. 3.

The bottom 14 is a part serving as a bottom wall of the U-shaped electric wire connection portion 12. The bottom 14 has a placement surface 14*a* on the inner wall surface side where the end of the electric wire 50 is placed during the crimping processing (FIGS. 8 to 10). In addition, the bottom 14 is placed on the support portions (the first support surface 112$A_1$ and the second support surface 112$B_1$) of the first mold 112, which will be described later, and is supported by the support portions during the crimping processing. The bottom 14 has a supported surface 14*b* that is supported by the support portion during the crimping processing on an outer wall surface side (FIGS. 2, 4, and 10).

Each of the first barrel piece 15 and the second barrel piece 16 is a piece extending from both ends in a crossing direction with respect to the axis of the end of the electric wire 50 at the bottom 14 (that is, in the second direction W). Each of the first barrel piece 15 and the second barrel piece 16 in this example is formed as a single piece continuous from the core wire crimping portion 12A to the sheath crimping portion 12B. Thus, the first barrel piece 15 and the second barrel piece 16 extend from both the ends of the bottom 14 so as to surround the end of the electric wire 50 placed on the bottom 14 in the U-shaped electric wire connection portion 12. Each of the first barrel piece 15 and the second barrel piece 16 is crimped to the core wire 51 and the sheath 52 of the end of the electric wire 50 at the core wire crimping portion 12A and the sheath crimping portion 12B. The respective first barrel piece 15 and the second barrel piece 16 are crimped to the end of the electric wire 50 while being pressed toward the support portions (the first support surface 112$A_1$ and the second support surface 112$B_1$) by the pressing portions (the core wire pressing portion 113$A_1$ and the sheath pressing portion 113$B_1$) of the second mold 113, which will be described later, during the crimping processing. The first barrel piece 15 and the second barrel piece 16 are wound around the end of the electric wire 50 by a pressing force from the pressing portion of the second mold 113 during the crimping processing.

The first barrel piece 15 and the second barrel piece 16 may be formed such that each distance thereof from the root of the bottom 14 side to end surfaces of distal ends 15*a* and 16*a* is the same length or may be formed such that one of the distances thereof is longer than the other. The first barrel piece 15 and the second barrel piece 16 are wound around the end of the electric wire 50 while overlapping each other.

In this example, the second barrel piece 16 is made longer than the first barrel piece 15. Thus, in the electric wire connection portion 12, an area where the first barrel piece 15 and the second barrel piece 16 overlap each other (hereinafter referred to as the "overlapping area") is formed after completion of crimping (not illustrated). Specifically, the overlapping area is an area where an outer wall surface of the first barrel piece 15 and an inner wall surface of the second barrel piece 16 oppose each other after completion of crimping. That is, in the electric wire connection portion 12, the first barrel piece 15 becomes a barrel piece wound around the end of the electric wire 50 at the inner side, and the second barrel piece 16 becomes a barrel piece wound around the end of the electric wire 50 at the outer side. Therefore, during the crimping processing, the first barrel piece 15 is wound around an outer circumferential surface of the end of the electric wire 50, and the second barrel piece 16 is wound so as to cover the end of the electric wire 50 in this state and the first barrel piece 15 from an outer circumferential surface side. In the electric wire connection portion 12, the first barrel piece 15 and the second barrel piece 16 are caulked to the end of the electric wire 50 in this manner.

Herein, the electric wire connection portion 12 before the crimping processing is formed in the U-shape with the bottom 14 and the pair of barrel pieces (the first barrel piece 15 and the second barrel piece 16). Thus, the electric wire connection portion 12 before the crimping processing has the space at the inner side of this U-shape and has an opening between the end surfaces of the respective distal ends 15*a* and 16*a*. At the time of performing the crimping processing, the end of the electric wire 50 is inserted into the inner space from the U-shaped opening of the electric wire connection portion 12. In a state where the end of the electric wire 50 is inserted into the space, the electric wire connection portion 12 is crimped to the end of the electric wire 50 by winding the pair of barrel pieces around the end of the electric wire 50 while shortening a distance between the first mold 112 and the second mold 113. In the electric wire connection portion 12, the core wire crimping portion 12A and the sheath crimping portion 12B are formed along with the winding of the pair of barrel pieces. Therefore, the distance between the first barrel piece 15 and the second barrel piece 16 is widened from the bottom 14 side toward the opening (the distal ends 15*a* and 16*a*) such that the end of the electric wire 50 is easily inserted in the electric wire connection portion 12.

Figure 7:
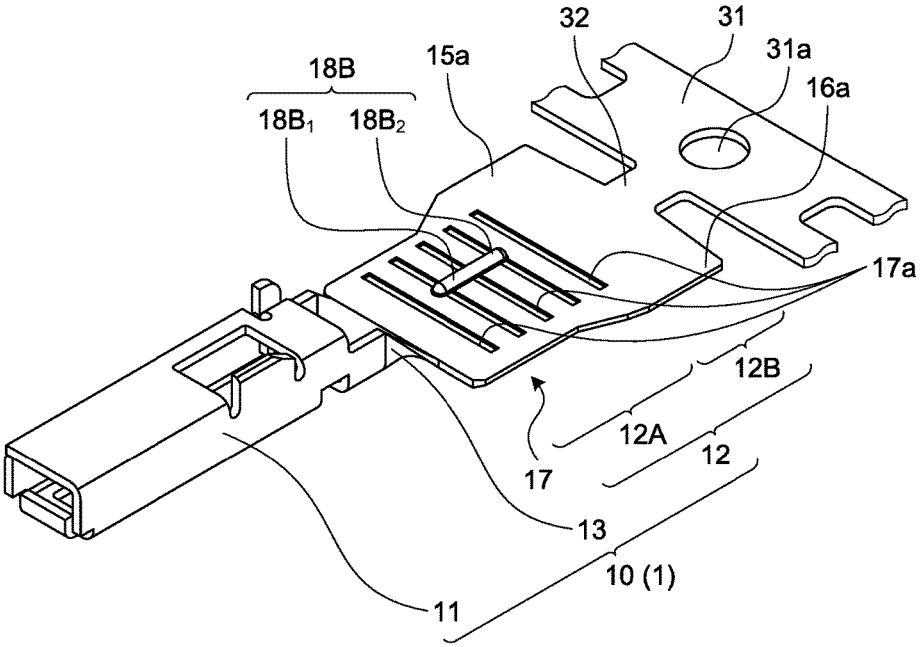
FIG. 7 is a perspective view illustrating the crimp terminal before the electric wire connection portion is formed in the U-shape.

A core wire holding area (hereinafter referred to as a "serration area") 17 for holding the crimped core wire 51 is provided on an inner wall surface (a wall surface on the side covering the end of the electric wire 50) of the electric wire connection portion 12 (FIGS. 7 to 9). The serration area 17 is constituted by a plurality of serrations 17*a* formed as recesses or protrusions. The serration area 17 increases the contact area between the electric wire connection portion 12 and the core wire 51 with the respective serrations 17*a* to increase adhesion strength therebetween and improve an electrical connection state therebetween. The serration area 17 is arranged at least in a part of the inner wall surface of the electric wire connection portion 12 which is wound around the bare core wire 51. The serration area 17 may be constituted by the plurality of concave serrations 17*a*, may be constituted by the plurality of convex serrations 17*a*, or may be constituted by the plurality of concave serrations 17*a* and the plurality of convex serrations 17*a* in combination. The serration area 17 in this example is formed so as to entirely cover the core wire 51 with the plurality of concave serrations 17*a*.

The bottom 14 of the core wire crimping portion 12A has a recess 18A (FIGS. 4, 6, and 8 to 10) obtained by recessing a part of the supported surface 14*b* toward the inner wall surface, and a protrusion 18B (FIGS. 7 to 10) protruding from the inner wall surface toward the core wire 51 at the end of the electric wire 50 by the recess of the recess 18A. The recess 18A and the protrusion 18B extend along a direction in which the electric wire 50 is drawn out from the crimp terminal 1.

As described above, the bottom 14 of the electric wire connection portion 12 is supported by the support portions (the first support surface 112$A_1$ and the second support surface 112$B_1$) of the first mold 112 to be described later. The recess 18A is used, for example, to achieve positioning of the electric wire connection portion 12 at the support portion and to hold a support posture of the electric wire connection portion 12 at the support portion. Accordingly, a convex pressing portion 112*a*, which will be described later, provided in the support portion of the first mold 112 is inserted in the recess 18A. As the distance between the first mold 112 and the second mold 113 is shortened during the crimping processing, a pressing force from the convex pressing portion 112*a* is applied on the wall surface of the recess 18A. The recess 18A is deformed into a shape in accordance with the shape of the convex pressing portion 112*a* by such a pressing force.

The protrusion 18B can sandwich the core wire 51 at the end of the electric wire 50 with the pair of barrel pieces (the first barrel piece 15 and the second barrel piece 16). The protrusion 18B protrudes from the inner wall surface when the recess 18A is formed. For example, the protrusion 18B is deformed into a shape corresponding to the shape of the convex pressing portion 112*a* in conjunction with the deformation of the recess 18A during the crimping processing. Accordingly, the protrusion 18B presses the core wire 51 at the end of the electric wire 50 with the pair of barrel pieces as the crimping processing progresses, and thus, can be used to enhance the crimping force after completion of crimping.

In the bottom 14 of the core wire crimping portion 12A, the serration 17*a* is formed at a place excluding the protrusion 18B.

Figure 11:
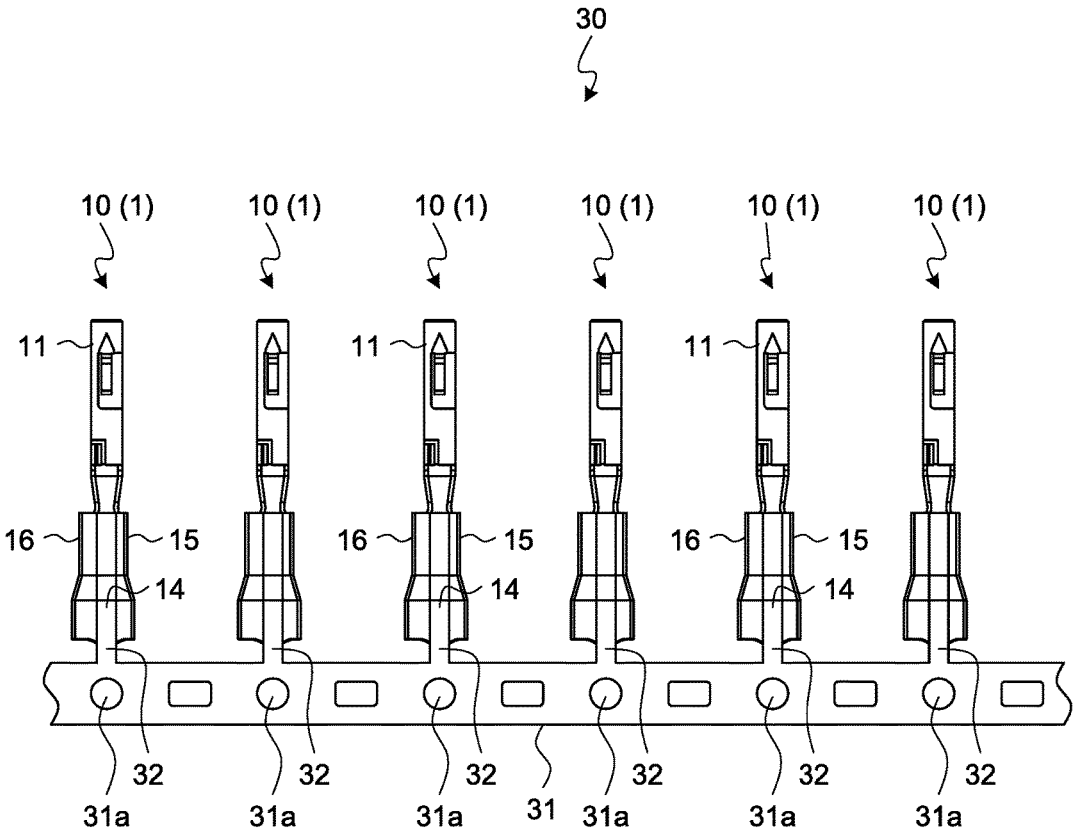
FIG. 11 is a view illustrating a terminal chain body.

In this crimp terminal 1, the terminal fitting 10 having the plate-shaped electric wire connection portion 12 is formed through the press molding step with respect to the base material (FIGS. 7 and 8). A plurality of the crimp terminals 1 are arranged side by side to form a chain body (hereinafter referred to as a "terminal chain body") 30 (FIG. 11). The terminal chain body 30 refers to an aggregate of the plurality of crimp terminals 1 arranged in parallel at regular intervals in the state of facing the same direction and connected in a chain shape. In the terminal chain body 30, one ends of all the crimp terminals 1 are connected by a coupling piece 31. The coupling piece 31 is formed into a rectangular plate shape, for example, and arranged with a predetermined distance with respect to the electric wire connection portions 12 of all the crimp terminals 1. The bottom 14 of the electric wire connection portion 12 and the coupling piece 31 are connected to each of the crimp terminals 1 via, for example, a rectangular plate-shaped connecting portion 32. Through holes (hereinafter referred to as "terminal feeding holes") 31*a* for feeding the terminal chain body 30 to a crimping position of a terminal crimping apparatus 100 are formed in the coupling piece 31 at regular intervals along a feeding direction of the terminal chain body 30. The terminal chain body 30 formed in this manner is arranged in the terminal crimping apparatus 100 (FIG. 12) in the state of being wound in a reel shape (not illustrated). In the terminal crimping apparatus 100, the electric wire connection portion 12 folded in a U-shape is crimped to the end of the electric wire 50. In addition, a terminal cutting step of separating the crimp terminal 1 from the terminal chain body 30 is performed simultaneously with a crimping step in the terminal crimping apparatus 100.

The terminal crimping apparatus 100 will be described.

Figure 12:
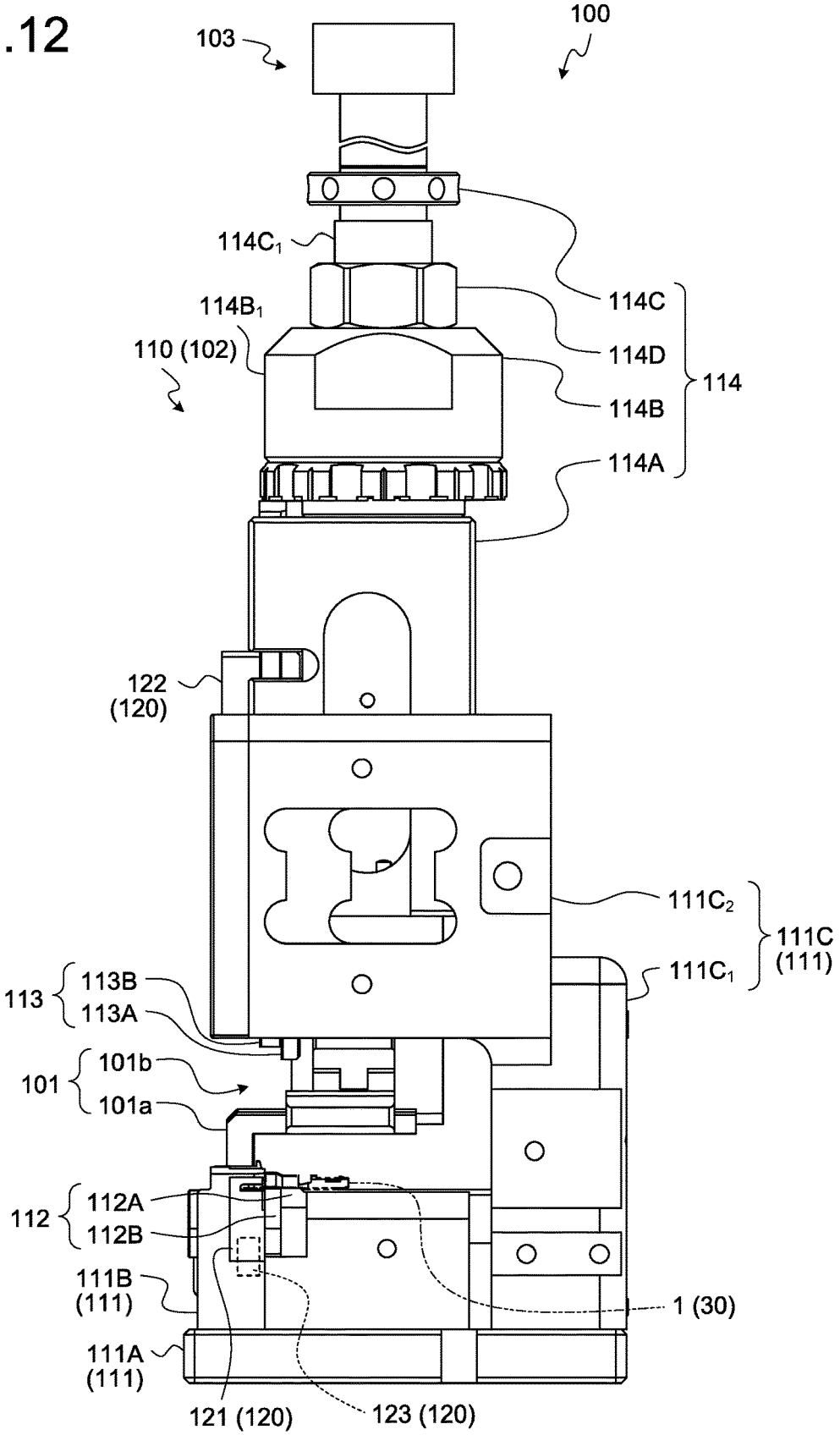
FIG. 12 is a view for describing a terminal crimping apparatus of the embodiment.

As illustrated in FIG. 12, the terminal crimping apparatus 100 includes a terminal supplying device 101 that supplies the crimp terminal 1 to a predetermined crimping position, a crimping apparatus 102 that crimps the crimp terminal 1 to the end of the electric wire 50 at the crimping position, and a driving device 103 configured to operate the terminal supplying device 101 and the crimping apparatus 102. The terminal supplying device 101 and the crimping apparatus 102 are devices called applicators in this technical field.

The terminal supplying device 101 draws out a leading crimp terminal 1 on an outer circumference side of the terminal chain body 30 wound in the reel shape to be successively supplied to the crimping position. After finishing crimping of the leading crimp terminal 1 to the end of the electric wire 50 and cutting thereof from the terminal chain body 30, the terminal supplying device 101 supplies a new leading crimp terminal 1 to the crimping position. The operation of the terminal supplying device 101 is repeated sequentially each time the crimping processing and the cutting processing are performed.

This terminal supplying device 101 has a well-known configuration in this technical field, and includes a terminal feeding member 101*a* which is inserted into the terminal feeding hole 31*a* of the coupling piece 31, and a power transmission mechanism 101*b* that drives the terminal feeding member 101*a* by power of the driving device 103. The power transmission mechanism 101*b* is configured as a link mechanism that operates in conjunction with the crimping operation of the crimping apparatus 102 (vertical movement of a ram 114A or the like to be described later). The terminal supplying device 101 in this example supplies the crimp terminal 1 to the crimping position by driving the terminal feeding member 101*a* in the vertical direction and the lateral direction in conjunction with the crimping operation of the crimping apparatus 102.

The crimping apparatus 102 performs crimping of the supplied crimp terminal 1 to the end of the electric wire 50 and separating of the crimp terminal 1 from the terminal chain body 30. Thus, the crimping apparatus 102 includes a crimping machine 110 and a terminal cutting machine 120.

The crimping machine 110 is a device that crimps the crimp terminal 1 to the end of the electric wire 50 by caulking the crimp terminal 1 supplied to the crimping position to the end of the electric wire 50. The crimping machine 110 in this example crimps the crimp terminal 1 to the electric wire 50 by caulking each of the first barrel piece 15 and the second barrel piece 16 of the crimp terminal 1 to the core wire 51 at the distal end and the sheath 52 of the electric wire 50. The crimping machine 110 includes a frame 111, the first mold 112 and the second mold 113 paired with each other, and a power transmission mechanism 114.

The frame 111 includes a base 111A, an anvil support 111B, and a support (hereinafter, referred to as a "transmission unit support") 111C for the power transmission mechanism 114. The base 111A is fixed onto a pedestal (not illustrated) on which the terminal crimping apparatus 100 is placed, for example. The anvil support 111B and the transmission unit support 111C are fixed onto the base 111A. The transmission unit support 111C is arranged at the rear side (the right side in the sheet plane in FIG. 12) and the upper side (the upper side in the sheet plane in FIG. 12) of the anvil support 111B. Specifically, the transmission unit support 111C includes a standing portion 111$C_1$ standing upward from the base 111A at the rear side of the anvil support 111B, and a ram support portion 111$C_2$ held at the upper part of the standing portion 111$C_1$. The ram support portion 111$C_2$ is a support portion that supports the ram 114A to be described later, and is arranged above the anvil support 111B with a predetermined distance therebetween.

Figure 13:
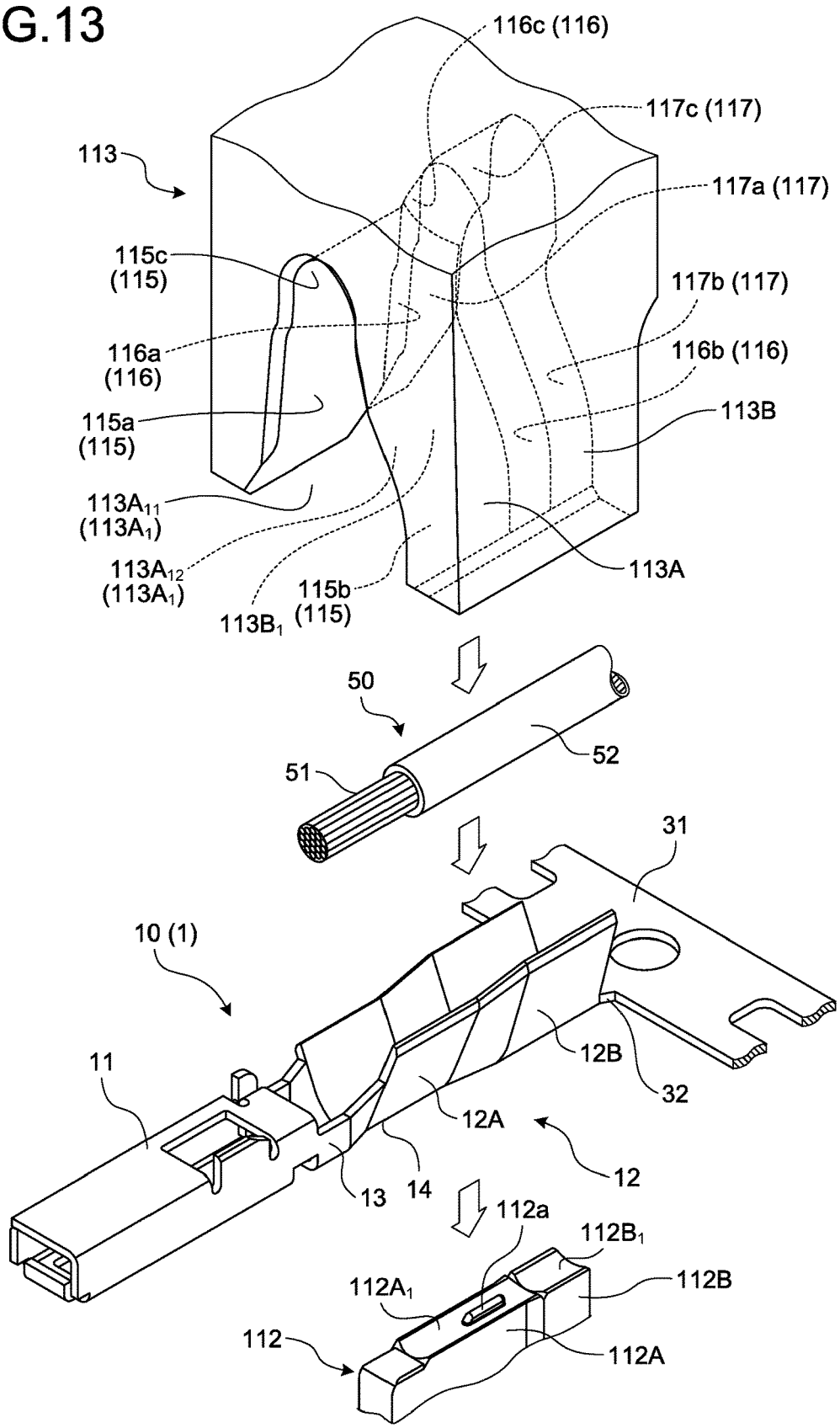
FIG. 13 is a perspective view for describing first and second molds.

The first mold 112 and the second mold 113 are arranged with a distance therebetween in the vertical direction, and are crimping molds that sandwich the crimp terminal 1 and the end of the electric wire 50 placed therebetween to crimp the crimp terminal 1 to the end of the electric wire 50 (FIG. 13). The first mold 112 is formed with two lower dies, and has a first anvil 112A and a second anvil 112B as the lower dies. The second mold 113 is formed with two upper dies, and has a first crimper 113A and a second crimper 113B as the upper dies. The first anvil 112A and the first crimper 113A are arranged to oppose each other in the vertical direction, and crimp the U-shaped core wire crimping portion 12A to the core wire 51 at the distal end by narrowing a distance therebetween. In addition, the second anvil 112B and the second crimper 113B are arranged to oppose each other in the vertical direction, and crimp the U-shaped sheath crimping portion 12B to the sheath 52 by narrowing a distance therebetween.

The driving device 103 transmits its power to the power transmission mechanism 114 to adjust the distance between the first anvil 112A and the first crimper 113A and the distance between the second anvil 112B and the second crimper 113B. At the time of performing the crimping processing, the space between the first anvil 112A and the first crimper 113A and the space between the second anvil 112B and the second crimper 113B are narrowed. On the other hand, when the crimping processing is finished, the space between the first anvil 112A and the first crimper 113A and the space between the second anvil 112B and the second crimper 113B are widened. In this example, the first crimper 113A and the second crimper 113B are vertically moved with respect to the first anvil 112A and the second anvil 112B at the same time by vertically moving the second mold 113 with respect to the first mold 112. However, the first anvil 112A, the second anvil 112B, the first crimper 113A, and the second crimper 113B may be molded bodies which are individually molded. In this case, the driving device 103 and the power transmission mechanism 114 may be configured to vertically move the first crimper 113A and the second crimper 113B separately. In this example, the crimping of the sheath crimping portion 12B by the second anvil 112B and the second crimper 113B starts after the crimping of the core wire crimping portion 12A is started by the first anvil 112A and the first crimper 113A.

The power transmission mechanism 114 of the present embodiment transmits the power output from the driving device 103 to the first crimper 113A and the second crimper 113B. As illustrated in FIG. 12, the power transmission mechanism 114 includes the ram 114A, a ram bolt 114B, and a shank 114C.

The ram 114A is a movable member that is supported to be vertically movable with respect to the ram support portion 111$C_2$. The second mold 113 is fixed to the ram 114A. Thus, the first crimper 113A and the second crimper 113B can vertically move with respect to the ram support portion 111$C_2$ integrally with the ram 114A. For example, the ram 114A is formed in a rectangular shape. A female screw (not illustrated) is formed in the ram 114A. The female screw is formed at an inner circumferential surface of a hole in the vertical direction formed toward an upper end surface from the inner side of the ram 114A.

The ram bolt 114B has a male screw (not illustrated) to be screwed into the female screw of the ram 114A. Thus, the ram bolt 114B can vertically move with respect to the ram support portion 111$C_2$ integrally with the ram 114A. In addition, the ram bolt 114B has a bolt head 114$B_1$ arranged above the male screw. The female screw (not illustrated) is formed on the bolt head 114$B_1$. The female screw is formed on the inner circumferential surface of the hole in the vertical direction formed from the inner side of the bolt head 114$B_1$ to the upper end surface.

The shank 114C is a cylindrical hollow member, and has a male screw 114$C_1$ and a connection portion (not illustrated) at the respective ends thereof. The male screw 114$C_1$ of the shank 114C is formed on the lower side of the hollow member and is screwed into the female screw of the bolt head 114$B_1$ of the ram bolt 114B. Thus, the shank 114C can move vertically with respect to the ram support portion 111$C_2$ integrally with the ram 114A and the ram bolt 114B. The connection portion is connected to the driving device 103.

The driving device 103 has a driving source (not illustrated) and a power conversion mechanism (not illustrated) that converts a driving force of the driving source into power in the vertical direction. The connection portion of the shank 114C is connected to an output shaft of the power conversion mechanism. Thus, the first crimper 113A and the second crimper 113B vertically move with respect to the ram support portion 111$C_2$ integrally with the ram 114A, the ram bolt 114B, and the shank 114C by the output of the driving device 103 (the output of the power conversion mechanism). As the driving source, an electric actuator such as an electric motor, a hydraulic actuator such as a hydraulic cylinder, a pneumatic actuator such as an air cylinder, or the like can be applied.

Here, a relative position of the second mold 113 with respect to the first mold 112 in the vertical direction can be changed by adjusting the amount of screwing of the female screw of the bolt head 114$B_1$ and the male screw 114$C_1$ of the shank 114C. That is, a relative position of the first crimper 113A with respect to the first anvil 112A in the vertical direction and a relative position of the second crimper 113B with respect to the second anvil 112B in the vertical direction can be changed by adjusting the screwing amount of the crimping machine 110. A nut 114D is screwed with the male screw 114$C_1$ of the shank 114C above the ram bolt 114B and has a function so-called a lock nut together with the female screw of the bolt head 114$B_1$. Thus, it is possible to fix the first crimper 113A and the second crimper 113B to the relative positions by fastening the nut 114D to the ram bolt 114B side after completion of the adjustment of the relative positions.

The first mold 112 has the support portion that supports the supported surface 14*b* of the bottom 14 of the crimp terminal 1 at the crimping position. The support portion is formed as the support surface capable of supporting the supported surface 14*b* by the surface. The first mold 112 includes the first support surface 112$A_1$ and the second support surface 112$B_1$ as the support portions thereof (FIG. 13). As the supported surface 14*b* of the bottom 14 of the core wire crimping portion 12A is placed, the first support surface 112$A_1$ supports the supported surface 14*b*. As the supported surface 14*b* of the bottom 14 of the sheath crimping portion 12B is placed, the second support surface 112$B_1$ supports the supported surface 14*b*.

Recessed surfaces recessed downward are formed at distal ends on each upper side of the first anvil 112A and the second anvil 112B, respectively. The recessed surface of the first anvil 112A is used as the first support surface 112$A_1$. In addition, the recessed surface of the second anvil 112B is used as the second support surface 112$B_1$. Each of the first support surface 112$A_1$ and the second support surface 112$B_1$ is formed in an arc shape in accordance with a shape of the bottom 14 of each of the U-shaped core wire crimping portion 12A and the U-shaped sheath crimping portion 12B. The first mold 112 is supported by the anvil support 111B in a state where the first support surface 112$A_1$ and the second support surface 112$B_1$ are exposed upward.

The crimp terminal 1 that has been supplied with the bottom 14 on the lower side thereof moves to a terminal support step of supporting the supported surface 14*b* of the bottom 14 with the first mold 112. In the terminal support step, when the crimp terminal 1 is supplied to the crimping position, the supported surface 14*b* of the bottom 14 of the core wire crimping portion 12A is supported by the first support surface 112$A_1$ at the upper end of the first anvil 112A, and the supported surface 14*b* of the bottom 14 of the sheath crimping portion 12B is supported by the second support surface 112$B_1$ at the upper end of the second anvil 112B.

The first mold 112 includes the convex pressing portion 112*a*, which protrudes from the first support surface 112$A_1$ to the second mold 113, on the first support surface 112$A_1$ (FIG. 13). The convex pressing portion 112*a* is a part that is inserted into the recess 18A, and is extended along the drawing direction of the electric wire 50 from the crimp terminal 1. When the supported surface 14*b* of the bottom 14 of the core wire crimping portion 12A is supported by the first support surface 112$A_1$ of the first anvil 112A, the convex pressing portion 112*a* is inserted into the recess 18A formed at the bottom 14 of the core wire crimping portion 12A. That is, when the supported surface 14*b* is supported by the first support surface 112$A_1$ in the terminal support step, the convex pressing portion 112*a* is inserted into the recess 18A. In the state of being inserted into the recess 18A, the convex pressing portion 112*a* presses and deforms the wall surface of the recess 18A while shortening the distance with respect to the second mold 113, thereby forming the protrusion 18B on the bottom 14 of the core wire crimping portion 12A.

In the terminal crimping apparatus 100, the processing proceeds to a step of crimping the crimp terminal 1 to the electric wire 50 after such a terminal support step is performed. In the crimping step, the bottom 14 and the pair of barrel pieces are sandwiched between the first mold 112 and the second mold 113 while shortening the distance between the first mold 112 and the second mold 113 in a state where the end of the electric wire 50 is inserted into the space surrounded by the bottom 14 and the pair of barrel pieces (the first barrel piece 15 and the second barrel piece 16). In the crimping step, the pair of barrel pieces is wound around the end of the electric wire 50 while shortening the distance between the first mold 112 and the second mold 113, thereby forming the core wire crimping portion 12A crimped to the core wire 51 and the sheath crimping portion 12B crimped to the sheath 52.

The second mold 113 shortens the distance with respect to the first mold 112 in the state where the end of the electric wire 50 is inserted into the space surrounded by the bottom 14 and the pair of barrel pieces (the first barrel piece 15 and the second barrel piece 16). The second mold 113 sandwiches the bottom 14 and the pair of barrel pieces together with the first mold 112 while shortening the distance with respect to the first mold 112 and winds the pair of barrel pieces around the end of the electric wire 50. The second mold 113 forms the core wire crimping portion 12A crimped to the core wire 51 and the sheath crimping portion 12B crimped to the sheath 52 by winding the pair of barrel pieces around the end of the electric wire 50.

The core wire pressing portion 113$A_1$, which crimps the pair of barrel pieces (the first barrel piece 15 and the second barrel piece 16) to the core wire 51 bare at the end of the electric wire 50, is formed in the first crimper 113A (FIG. 13). In addition, the sheath pressing portion 113$B_1$ which crimps the pair of barrel pieces to the sheath 52 at the end of the electric wire 50, is formed in the first crimper 113A (FIG. 13). Each of the core wire pressing portion 113$A_1$ and the sheath pressing portion 113$B_1$ has a concave shape recessed upward.

The core wire pressing portion 113$A_1$ is arranged to oppose the first support surface 112$A_1$ of the first anvil 112A in the vertical direction. The core wire pressing portion 113$A_1$ crimps the core wire crimping portion 12A supported on the first support surface 112$A_1$ to the core wire 51. The sheath pressing portion 113$B_1$ is arranged to oppose the second support surface 112$B_1$ of the second anvil 112B in the vertical direction. The sheath pressing portion 113$B_1$ crimps the sheath crimping portion 12B supported on the second support surface 112$B_1$ to the sheath 52. When the crimping processing is performed, the core wire pressing portion 113$A_1$ and the sheath pressing portion 113$B_1$ contact the first barrel piece 15 and the second barrel piece 16, respectively, and caulk the first barrel piece 15 and the second barrel piece 16 to the end of the electric wire 50 while winding the first barrel piece 15 and the second barrel piece 16.

The core wire pressing portion 113$A_1$ and the sheath pressing portion 113$B_1$ are arranged such that the distance between the core wire pressing portion 113$A_1$ and the first support surface 112$A_1$ in a relative movement direction between the first mold 112 and the second mold 113 is narrower than the distance between the sheath pressing portion 113$B_1$ and the second support surface 112$B_1$ in the relative movement direction. As a result, the electric wire connection portion 12 is crimped to the end of the electric wire 50 in a state where a distance between the bottom 14 and the pair of barrel pieces in a direction of sandwiching the sheath 52 in the sheath crimping portion 12B is set to be wider than a distance between the bottom 14 and the pair of barrel pieces (the first barrel piece 15 and the second barrel piece 16) in a direction of sandwiching the core wire 51 in the core wire crimping portion 12A. Accordingly, the core wire pressing portion 113$A_1$ has a first core wire pressing portion 113$A_{11}$ and a second core wire pressing portion 113$A_{12}$ so as to smoothly connect the core wire crimping portion 12A and the sheath crimping portion 12B (FIG. 13).

The first core wire pressing portion 113$A_{11}$ is formed to be arranged to oppose the first support surface 112$A_1$ of the first anvil 112A in the vertical direction and to crimp the pair of barrel pieces (the first barrel piece 15 and the second barrel piece 16) to the distal end side of the core wire 51. Accordingly, the first core wire pressing portion 113$A_{11}$ is arranged to oppose the first support surface 112$A_1$ on the side opposite to the second support surface 112$B_1$. On the other hand, the second core wire pressing portion 113$A_{12}$ is formed to be arranged to oppose the first support surface 112$A_1$ of the first anvil 112A in the vertical direction and to crimp the pair of barrel pieces to the core wire 51 existing between the first core wire pressing portion 113$A_{11}$ and the sheath pressing portion 113$B_1$. Accordingly, the second core wire pressing portion 113$A_{12}$ is arranged to oppose the first support surface 112$A_1$ on the second support surface 112$B_1$ side, that is, to oppose the second support surface 112$B_1$ between the first core wire pressing portion 113$A_{11}$ and the sheath pressing portion 113$B_1$. The second core wire pressing portion 113$A_{12}$ crimps the pair of barrel pieces to the core wire 51 while widening the distance between the bottom 14 and the pair of barrel pieces in the sandwiching direction of the core wire 51 as being directed from the first core wire pressing portion 113$A_{11}$ side to the sheath pressing portion 113$B_1$ side between the first core wire pressing portion 113$A_{11}$ and the sheath pressing portion 113$B_1$.

The core wire pressing portion 113$A_1$ causes the core wire crimping portion 12A to have a first core wire crimping portion 12$A_1$ crimped by the first core wire pressing portion 113$A_{11}$ and a second core wire crimping portion 12$A_2$ crimped by the second core wire pressing portion 113$A_{12}$ (FIGS. 3 to 6 and 10). In the first core wire crimping portion 12$A_1$, the pair of barrel pieces is crimped to the distal end side of the core wire 51. In the second core wire crimping portion 12$A_2$, the pair of barrel pieces is crimped to the core wire 51 between the distal end of the core wire 51 and the sheath 52. The second core wire crimping portion 12$A_2$ widens the distance with respect to the bottom 14 in the sandwiching direction of the core wire 51 as being directed from the first core wire crimping portion 12$A_1$ side to the sheath crimping portion 12B side between the first core wire crimping portion 12$A_1$ and the sheath crimping portion 12B such that the pair of barrel pieces is wound around the core wire 51. Accordingly, the core wire crimping portion 12A and the sheath crimping portion 12B are smoothly connected in the electric wire connection portion 12 after completion of crimping.

The first core wire pressing portion 113$A_{11}$, the second core wire pressing portion 113$A_{12}$, and the sheath pressing portion 113$B_1$ have pressing surfaces 115, 116, and 117, respectively, that contact the first barrel piece 15 and the second barrel piece 16 and caulk the first barrel piece 15 and the second barrel piece 16 to the end of the electric wire 50 while winding the first barrel piece 15 and the second barrel piece 16 when the crimping processing is performed (FIG. 13). The respective pressing surfaces 115, 116, and 117 are formed so as to perform such a caulking operation. For example, the pressing surface 115 has first and second wall surfaces 115*a* and 115*b* opposing each other, and an arc-shaped third wall surface 115*c* connecting upper ends of the first and second wall surfaces 115*a* and 115*b*. Similarly, the pressing surface 116 has first and second wall surfaces 116*a* and 116*b* opposing each other and an arc-shaped third wall surface 116*c* connecting upper ends of the first and second wall surfaces 116*a* and 116*b*. In addition, the pressing surface 117 has first and second wall surfaces 117*a* and 117*b* opposing each other and an arc-shaped third wall surface 117*c* connecting upper ends of the first and second wall surfaces 117*a* and 117*b*. Crimping shapes of the first core wire crimping portion $\mathbf{12}A_1$, the second core wire crimping portion $\mathbf{12}A_2$, and the sheath crimping portion 12B on the pair of barrel pieces side are formed by the respective third wall surfaces 115*c*, 116*c*, and 117*c* of the pressing surfaces 115, 116, and 117.

In the crimping step, the first core wire crimping portion $\mathbf{12}A_1$ is formed as the pair of barrel pieces (the first barrel piece 15 and the second barrel piece 16) is crimped to the distal end side of the core wire 51 by the first core wire pressing portion $\mathbf{113}A_{11}$. Further, at the same timing as the step of forming the first core wire crimping portion $\mathbf{12}A_1$ in the crimping step, the second core wire crimping portion $\mathbf{12}A_2$ is formed as the second core wire pressing portion $\mathbf{113}A_{12}$ crimps the pair of barrel pieces to the core wire 51 while widening the distance between the bottom 14 and the pair of barrel pieces in the sandwiching direction of the core wire 51 as being directed from the first core wire pressing portion $\mathbf{113}A_{11}$ side to the sheath pressing portion $\mathbf{113}B_1$ side. In addition, at the same timing as the step of forming the core wire crimping portion 12A in the crimping step, the sheath crimping portion 12B is further formed as the sheath pressing portion $\mathbf{113}B_1$ crimps the pair of barrel pieces to the sheath 52.

Since the convex pressing portion 112*a* is in the state of being inserted in the recess 18A of the core wire crimping portion 12A in the previous terminal support step, the wall surface of the recess 18A is pressed by the convex pressing portion 112*a* while crimping the pair of barrel pieces to the end of the electric wire 50 in this crimping step. Accordingly, the protrusion 18B is formed in the bottom 14 of the core wire crimping portion 12A by deforming the wall surface of the recess 18A with the convex pressing portion 112*a* in this crimping step.

As described above, the recess 18A and the protrusion 18B have shapes corresponding to a shape of the convex pressing portion 112*a*. Therefore, the convex pressing portion 112*a* is formed in the following shape in the present embodiment.

Figure 14:
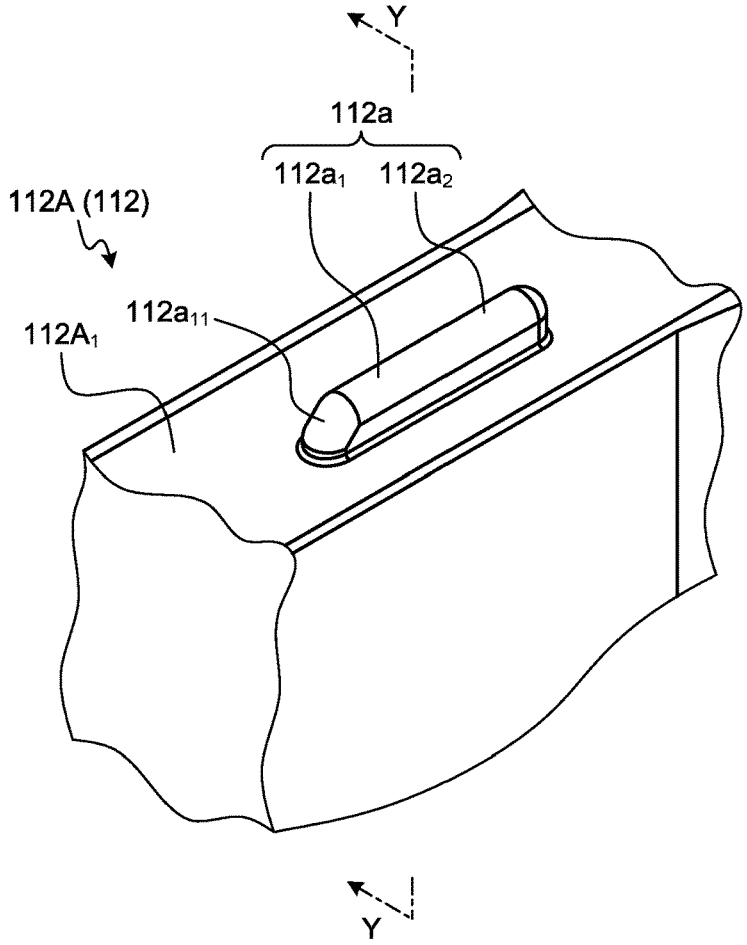
FIG. 14 is a perspective view for describing a convex pressing portion.
Figure 15:
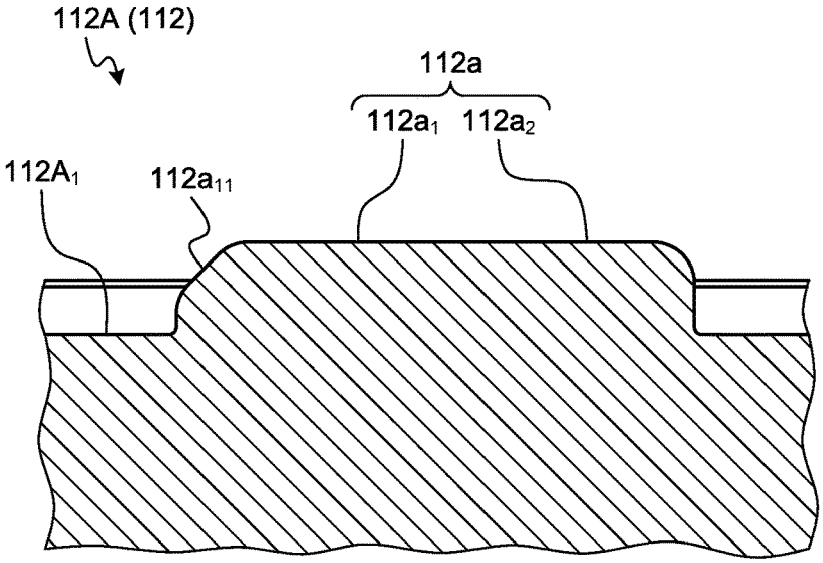
FIG. 15 is a cross-sectional view taken along a line Y-Y of FIG. 14.

The convex pressing portion 112*a* of the present embodiment has a first pressing portion $\mathbf{112}a_1$ arranged to oppose the first core wire pressing portion $\mathbf{113}A_{11}$ and a second pressing portion $\mathbf{112}a_2$ arranged to oppose the second core wire pressing portion $\mathbf{113}A_{12}$ (FIGS. 14 and 15). The first pressing portion $\mathbf{112}a_1$ is inserted into the first core wire crimping portion $\mathbf{12}A_1$ side of the recess 18A and presses the wall surface of the recess 18A on the first core wire crimping portion $\mathbf{12}A_1$ side during the crimping processing. The second pressing portion $\mathbf{112}a_2$ is inserted into the second core wire crimping portion $\mathbf{12}A_2$ side of the recess 18A and presses the wall surface of the recess 18A on the second core wire crimping portion $\mathbf{12}A_2$ side during the crimping processing. Accordingly, the recess 18A and the protrusion 18B are formed over the first core wire crimping portion $\mathbf{12}A_1$ and the second core wire crimping portion $\mathbf{12}A_2$. The recess 18A has a first recess $\mathbf{18}A_1$ formed by the first pressing portion $\mathbf{112}a_1$ and a second recess $\mathbf{18}A_2$ formed by the second pressing portion $\mathbf{112}a_2$ (FIGS. 4, 6, 10, and 16). In addition, the protrusion 18B has a first protrusion $\mathbf{18}B_1$ formed by the first pressing portion $\mathbf{112}a_1$ and a second protrusion $\mathbf{18}B_2$ formed by the second pressing portion $\mathbf{112}a_2$ (see FIGS. 7, 10, and 16).

In a cross section orthogonal to the drawing direction of the electric wire 50 from the crimp terminal 1, at least a part of the convex pressing portion 112*a* of the present embodiment, arranged to oppose the core wire pressing portion $\mathbf{113}A_1$, is formed in an arc shape. The first pressing portion $\mathbf{112}a_1$ and the second pressing portion $\mathbf{112}a_2$ are formed such that the arc-shaped parts thereof have the same shape and the respective arc-shaped parts and the first support surface $\mathbf{112}A_1$ are arranged with an equal distance.

Figure 16:
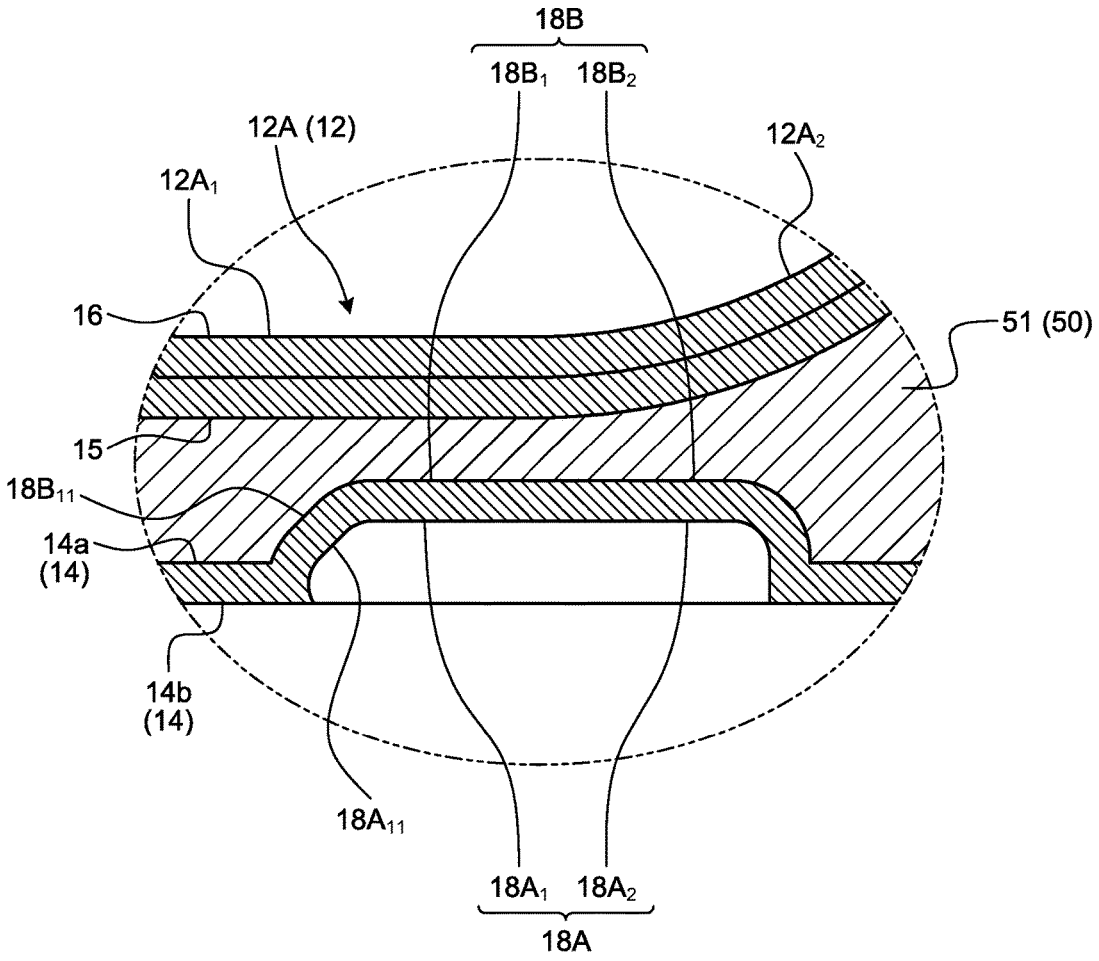
FIG. 16 is an enlarged view of a section A in FIG. 10.

However, an end $\mathbf{112}a_{11}$ of the first pressing portion $\mathbf{112}a_1$ of the convex pressing portion 112*a* on the side opposite to the second support surface $\mathbf{112}B_1$ side is inclined to the second support surface $\mathbf{112}B_1$ side (that is, the second pressing portion $\mathbf{112}a_2$ side) as being directed in a protruding direction of the convex pressing portion 112*a* (FIGS. 14 and 15). When the first recess $\mathbf{18}A_1$ of the recess 18A is formed, the end $\mathbf{112}a_{11}$ causes an end $\mathbf{18}A_{11}$ of the first recess $\mathbf{18}A_1$ of the recess 18A on the side opposite to the sheath crimping portion 12B side to be inclined to the sheath crimping portion 12B side (that is, to the second recess $\mathbf{18}A_2$ side) as being directed from the outer wall surface side to the inner wall surface side (FIGS. 4, 10, and 16). In addition, when the first protrusion $\mathbf{18}B_1$ of the protrusion 18B is formed, the end $\mathbf{112}a_{11}$ causes an end $\mathbf{18}B_{11}$ of the first protrusion $\mathbf{18}B_1$ of the protrusion 18B on the side opposite to the sheath crimping portion 12B side to be inclined to the sheath crimping portion 12B side (that is, to the second protrusion $\mathbf{18}B_2$ side) as being directed from the outer wall surface side to the inner wall surface side (FIGS. 10 and 16). That is, when the recess 18A and the protrusion 18B are formed in the crimping step, the respective ends $\mathbf{18}A_{11}$ and $\mathbf{18}B_{11}$ of the recess 18A and the protrusion 18B are inclined to the sheath crimping portion 12B side as being directed from the outer wall surface side to the inner wall surface side as the wall surface of the recess 18A is pressed by the convex pressing portion 112*a* having the end $\mathbf{112}a_{11}$.

A thickness formed by the respective ends $\mathbf{18}A_{11}$ and $\mathbf{18}B_{11}$ can be increased as compared with the related art when comparing a thickness formed by the inclined end $\mathbf{112}a_{11}$ and a thickness formed by an end $\mathbf{112}a_{11}$ with no inclination (end having a wall surface rising upward in a protruding direction of a convex pressing portion 112*a*) of the related art. That is, in the recess 18A and the protrusion 18B formed by the inclined end $\mathbf{112}a_{11}$, it is possible to make the thickness formed by the respective ends $\mathbf{18}A_{11}$ and $\mathbf{18}B_{11}$ approximate to a thickness formed by the first recess $\mathbf{18}A_1$ and the first protrusion $\mathbf{18}B_1$ other than the ends $\mathbf{18}A_{11}$ and $\mathbf{18}B_{11}$ and a thickness formed by the second recess $\mathbf{18}A_2$ and the second protrusion $\mathbf{18}B_2$. Therefore, it is more difficult to elongate the core wire crimping portion 12A in the axial direction during the crimping processing as compared with the related art. Accordingly, since it is possible to reduce the amount of elongation of the core wire crimping portion 12A after completion of crimping in the terminal-equipped electric wire 50A, it is possible to reduce the elongation amount of the crimp terminal 1 after completion of crimping while securing the crimping force of the crimp terminal 1 with respect to the electric wire 50.

Figure 17:
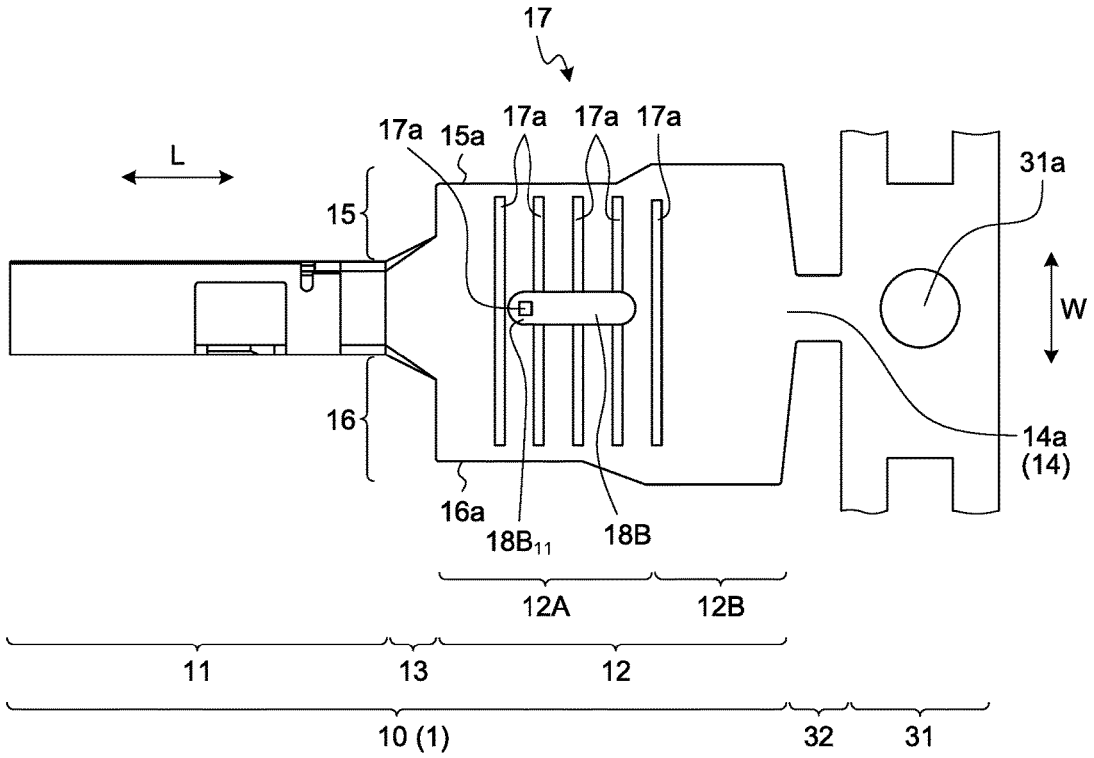
FIG. 17 is a top view illustrating another aspect of the crimp terminal before the electric wire connection portion is formed in the U-shape.

Here, it is possible to increase the thickness of the end $\mathbf{18}B_{11}$ (the thickness formed between the respective ends $\mathbf{18}A_{11}$ and $\mathbf{18}B_{11}$) in the protrusion 18B, and thus, the serration 17*a* recessed toward the recess 18A may be formed at the end $\mathbf{18}B_{11}$. In this case, it is preferable to form the concave serration 17*a* even on the first protrusion $\mathbf{18}B_1$ and the second protrusion $\mathbf{18}B_2$ other than the end $\mathbf{18}B_{11}$. As a result, it is possible to further enhance the adhesion strength between the electric wire connection portion 12 and the core wire 51 and to further improve the electrical connection state therebetween in the terminal-equipped electric wire 50A. For example, the serration 17*a* is formed before performing the crimping processing (FIG. 17).

Figure 18:
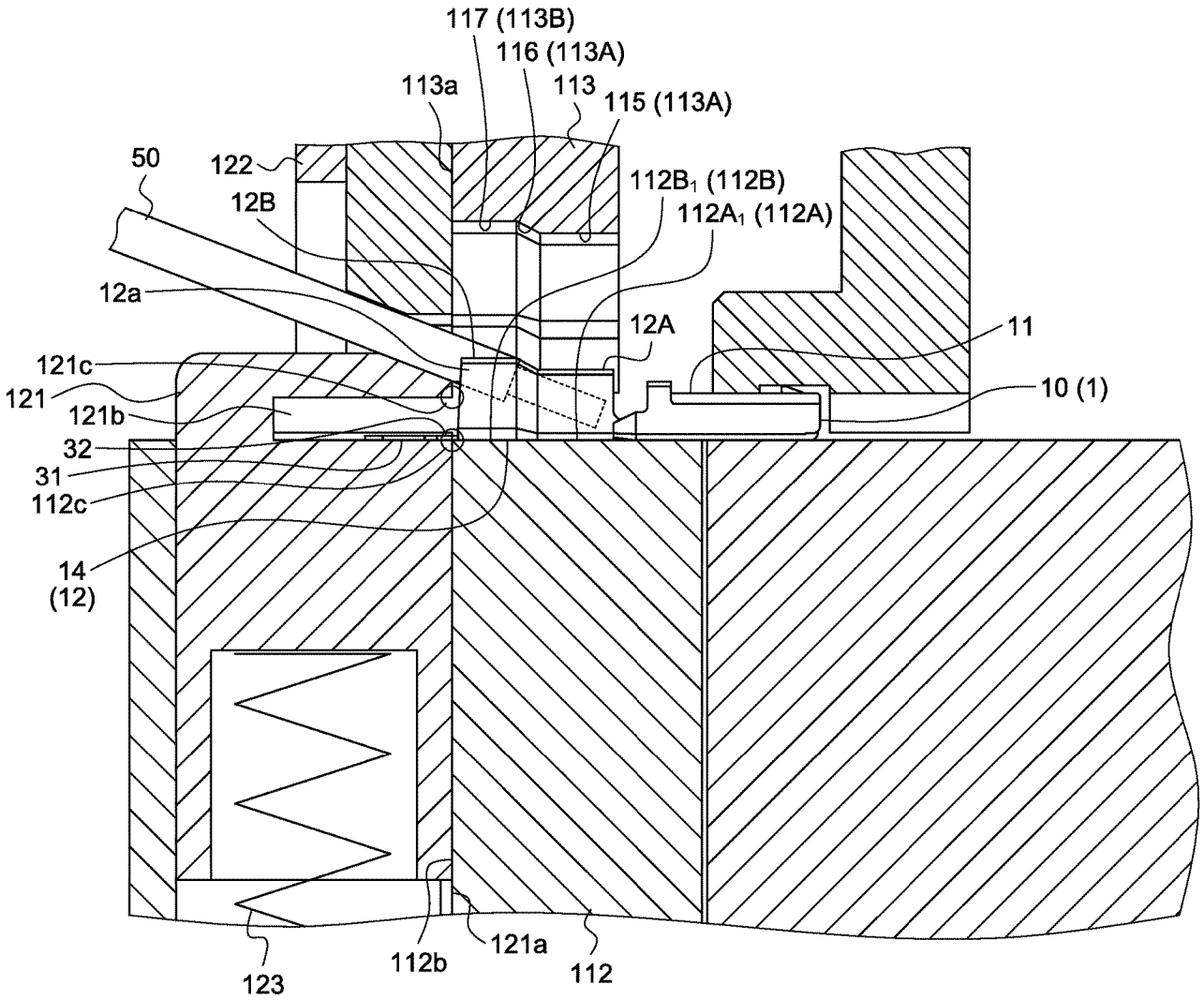
FIG. 18 is a view for describing a part of a crimping step.

The terminal cutting machine 120 is configured to sandwich the connecting portion 32 of the crimp terminal 1 supplied to the crimping position with two terminal cutting portions and cut the connecting portion 32. The terminal cutting machine 120 performs the separating of the crimp terminal 1 from the coupling piece 31 at the same time as the progression of the crimping processing. The terminal cutting machine 120 is arranged on the front side (the left side of the sheet plane of FIG. 12) of the second anvil 112B. The terminal cutting machine 120 is well known in this technical field and includes, for example, a terminal cutter 121, a pressing member 122, and an elastic member 123 (FIG. 18).

The terminal cutter 121 is formed in a rectangular parallelepiped shape and is arranged so as to be slidable in the vertical direction along a front surface (one end surface 112*b*) of the second anvil 112B. The terminal cutter 121 has a slide contact surface 121*a* that slides along the end surface 112*b* of the second anvil 112B. A slit 121*b* is formed inwardly from the slide contact surface 121*a* in the terminal cutter 121. The slit 121*b* is an internal space into which the coupling piece 31 is inserted in a state where a part of the connecting portion 32 connected to the crimp terminal 1 protrudes when the crimp terminal 1 to be crimped is supplied to the crimping position. Here, a position where the coupling piece 31 and the like can be inserted into the slit 121*b* is defined as an initial position of the terminal cutter 121 in the vertical direction. An end of the connecting portion 32 on the electric wire connection portion 12 side protrudes from the inside of the slit 121*b* through an opening of the slit 121*b* on the slide contact surface 121*a* side (that is, on the crimp terminal 1 side). In the terminal cutter 121, an upper edge (hereinafter referred to as an "opening edge") 121*c* of the opening is used as one terminal cutting portion.

The pressing member 122 is fixed to the ram 114A and vertically moves integrally with the ram 114A. The pressing member 122 is arranged above the terminal cutter 121 and descends to press down the terminal cutter 121. The pressing member 122 is formed in a rectangular parallelepiped shape. The elastic member 123 applies an upward biasing force to the terminal cutter 121, and is made of a spring member or the like. When a pressing force from the pressing member 122 is released, the elastic member 123 causes the terminal cutter 121 to return to the initial position in the vertical direction.

In the terminal cutting machine 120, the pressing member 122 descends along with the descending of the second mold 113 during the crimping processing, thereby pressing down the terminal cutter 121. As the terminal cutter 121 descends in the terminal cutting machine 120, the connecting portion 32 is sandwiched between the opening edge 121*c* of the slit 121*b* and an upper surface edge 112*c* (FIG. 18) as the other terminal cutting portion of the second anvil 112B. The opening edge 121*c* and the upper surface edge 112*c* act as scissors in the terminal cutting machine 120. Therefore, as the terminal cutter 121 is further pressed down in the terminal cutting machine 120, the connecting portion 32 is cut by the opening edge 121*c* and the upper surface edge 112*c*, and the crimp terminal 1 is separated from the terminal chain body 30.

During the crimping processing, the electric wire connection portion 12 is surrounded by the first and second support surfaces 112$A_1$ and 112$B_1$ and the pressing surfaces 115, 116, and 117, and a force releasing path remains only in its axial direction (the drawing direction of the electric wire 50). For example, in the terminal crimping apparatus 100, the crimping of the core wire crimping portion 12A by the first anvil 112A and the first crimper 113A starts first, and thereafter, the crimping of the sheath crimping portion 12B by the second anvil 112B and the second crimper 113B starts. Accordingly, the force is released to an end 12*a* (FIG. 18) side in the electric wire connection portion 12 along with the progressing of the crimping processing. The end 12*a* is an end on the side from which the electric wire 50 is drawn out after completion of crimping. However, it is possible to reduce the elongation amount of the core wire crimping portion 12A in the electric wire connection portion 12 after completion of crimping as described above, and thus, it is possible to suppress the elongation of the electric wire 50 on the end 12*a* side toward the drawing direction.

Figure 19:
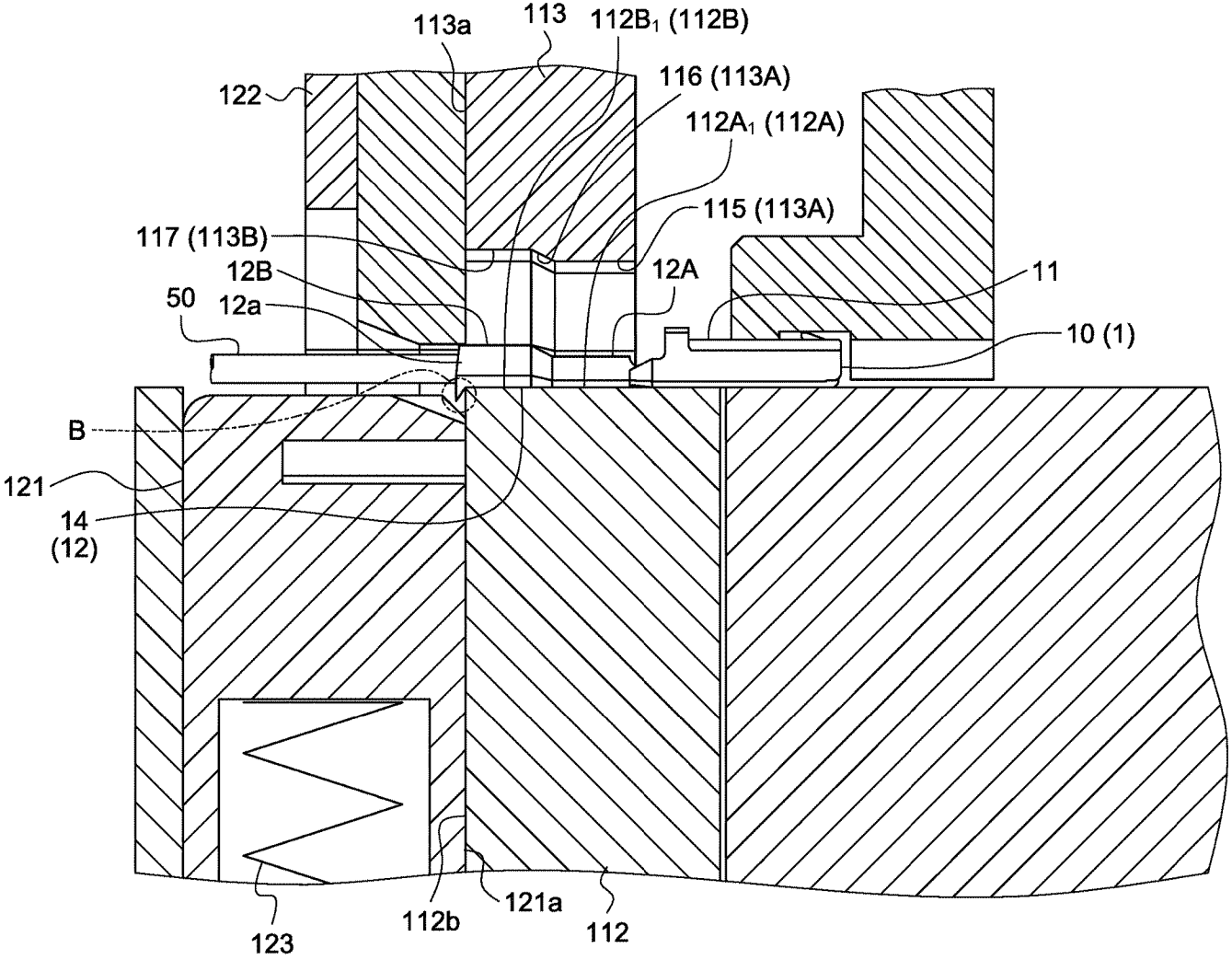
FIG. 19 is a view illustrating a state after completion of crimping of a crimp terminal of the related art.

In addition, when the end 12*a* side of the electric wire connection portion 12 is elongated, the end 12*a* side sticks out of the end surface 112*b* of the second anvil 112B so that there is a possibility that it becomes difficult to support the sticking-out end 12*a* side by the second support surface 112$B_1$ of the second anvil 112B (FIG. 19). Here, there is a case where the end surface 112*b* of the second anvil 112B and the slide contact surface 121*a* of the terminal cutter 121 are offset toward the terminal connection portion 11 with respect to the front surface (one end surface 113*a*) of the first crimper 113A in the terminal crimping apparatus 100 so as to prevent the cut connecting portion 32 from remaining on the crimp terminal 1 side as much as possible. In this case, the end 12*a* side of the bottom 14 is not supported by the second support surface 112$B_1$ of the second anvil 112B in the first place in the electric wire connection portion 12. Further, there is a possibility that the end 12*a* side of the bottom 14 sticks out along the end surface 112*b* of the second anvil 112B along with the progressing of the crimping processing unless being supported by the second support surface 112$B_1$ (a section B of FIG. 19). However, it is possible to reduce the elongation amount of the core wire crimping portion 12A in the electric wire connection portion 12 after completion of crimping as described above, and thus, it is possible to suppress such sticking-out along the end surface 112*b* of the second anvil 112B.

As described above, the terminal-equipped electric wire 50A, the terminal crimping apparatus 100, and the method of manufacturing a terminal-equipped electric wire according to the present embodiment can reduce the elongation amount of the core wire crimping portion 12A after completion of crimping and reduce the elongation amount of the crimp terminal 1 after completion of crimping while securing the crimping force of the crimp terminal 1 with respect to the electric wire 50. Since the terminal-equipped electric wire 50A, the terminal crimping apparatus 100, and the method of manufacturing a terminal-equipped electric wire can reduce the elongation amount of the core wire crimping portion 12A after completion of crimping, it is possible to suppress the sticking-out of the end 12*a* side of the bottom 14 along the end surface 112*b* of the second anvil 112B at the time of finishing the crimping processing. In this manner, the terminal-equipped electric wire 50A, the terminal crimping apparatus 100, and the method of manufacturing a terminal-equipped electric wire according to the present embodiment can suppress the increase in size of the crimp terminal 1. Therefore, the accommodability at the time of accommodating the crimp terminal 1 in a housing is improved in the terminal-equipped electric wire 50A, the terminal crimping apparatus 100, and the method of manufacturing a terminal-equipped electric wire, and accordingly, it is possible to improve the workability of accommodating the crimp terminal 1 in the housing. In addition, the terminal-equipped electric wire 50A, the terminal crimping apparatus 100, and the method of manufacturing a terminal-equipped electric wire can suppress the increase in size of the crimp terminal 1 while securing the crimping force of the crimp terminal 1 with respect to the electric wire 50. That is, the terminal-equipped electric wire 50A, the terminal crimping apparatus 100, and the method of manufacturing a terminal-equipped electric wire of the present embodiment can suppress the increase in size of the crimp terminal 1 while securing the crimping force of the crimp terminal 1 with respect to the electric wire 50 to keep the electrical connection state between the crimp terminal 1 and the electric wire 50 at a desired state, and concomitantly, can improve the accommodability of the crimp terminal 1 to the housing and the accommodation workability.

Figure 20:
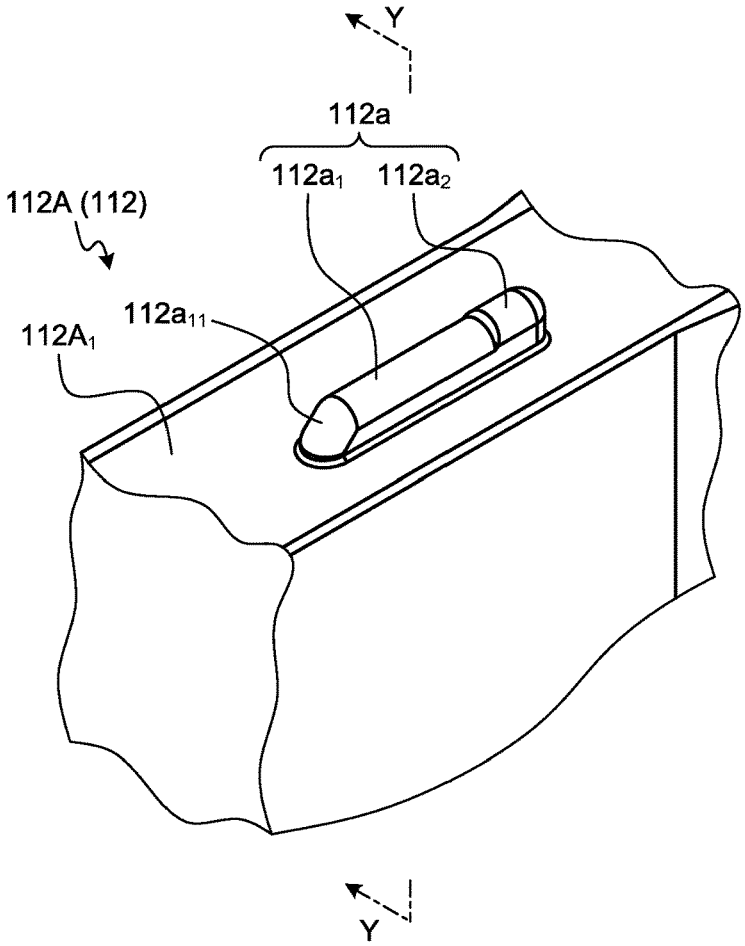
FIG. 20 is a perspective view for describing a modification of a convex pressing portion.
Figure 21:
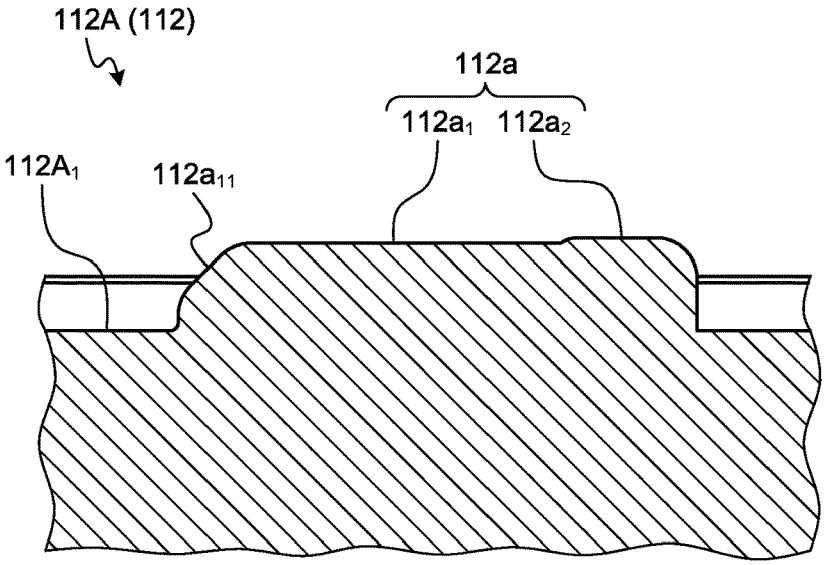
FIG. 21 is a cross-sectional view taken along a line Y-Y of FIG. 20.

Here, in the convex pressing portion 112*a* in the above-described example, the first pressing portion 112$a_1$ and the second pressing portion 112$a_2$ other than the end 112$a_{11}$ are continuous as the same arc shape, and no step is provided between the first pressing portion 112$a_1$ and the second pressing portion 112$a_2$. However, the convex pressing portion 112*a* may have a step between the first pressing portion 112$a_1$ and the second pressing portion 112$a_2$ by causing the second pressing portion 112$a_2$ to protrude more than the first pressing portion 112$a_1$ (FIGS. 20 and 21). That is, a protruding amount of the second pressing portion 112$a_2$ from the first support surface 112$A_1$ is made larger than a protruding amount of the first pressing portion 112$a_1$ from the first support surface 112$A_1$ in this convex pressing portion 112*a*. Here, the second pressing portion 112$a_2$ is formed to protrude such that a distance between the second pressing portion 112$a_2$ and the third wall surface 116*c* of the pressing surface 116 of the second core wire pressing portion 113$A_{12}$ approximates to a distance between the first pressing portion 112$a_1$ and the third wall surface 115*c* of the pressing surface 115 of the first core wire pressing portion 113$A_{11}$ in the relative movement direction of the first mold 112 and the second mold 113.

Figure 22:
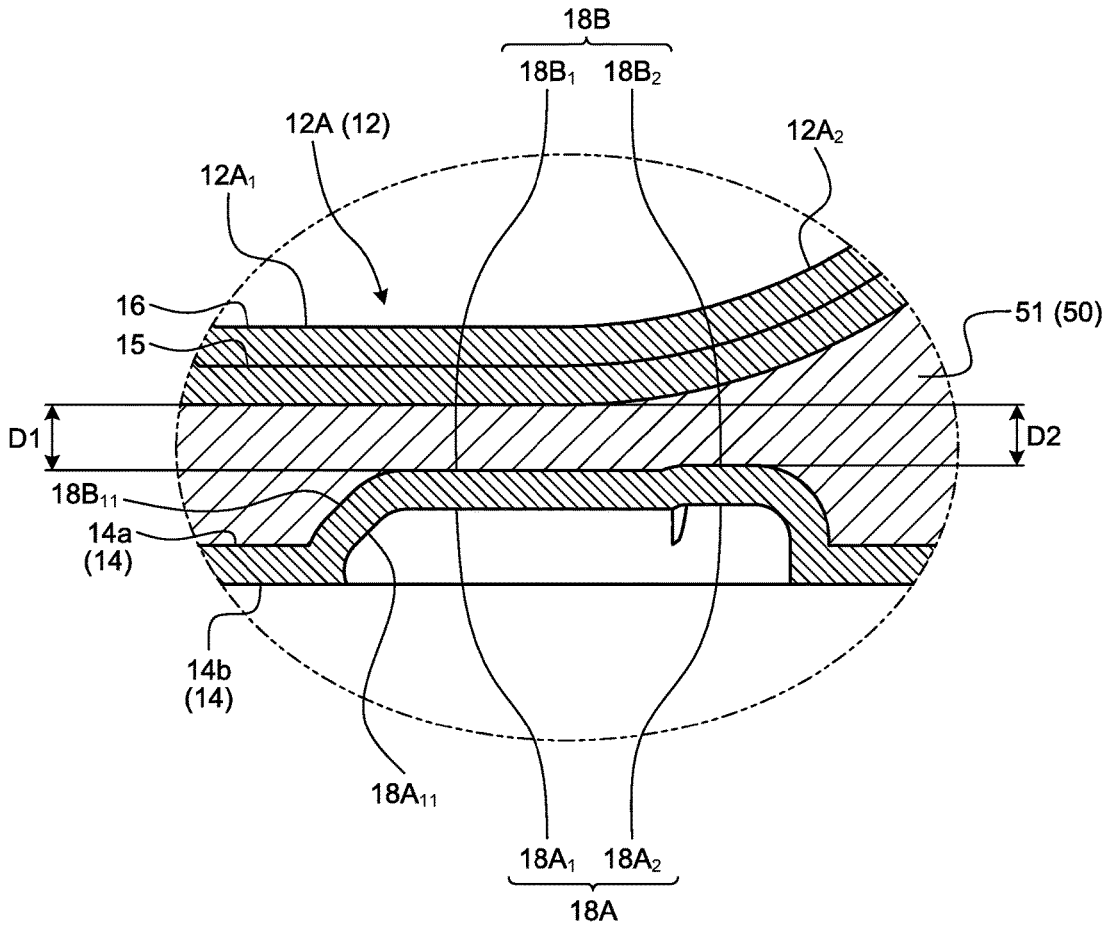
FIG. 22 is a cross-sectional view corresponding to FIG. 16, and is a view for describing a modification of a recess and a protrusion.

In the case of using the above-described convex pressing portion 112*a*, the wall surface of the recess 18A is pressed by the first pressing portion 112$a_1$ at the time of forming the recess 18A and the protrusion 18B in the crimping step, thereby forming the first recess 18$A_1$ of the recess 18A and forming the first protrusion 18$B_1$ of the protrusion 18B caused to protrude by the recess of the first recess 18$A_1$. Further, the wall surface of the recess 18A is pressed by the second pressing portion 112$a_2$ at the time of forming the recess 18A and the protrusion 18B in the crimping step, thereby forming the second recess 18$A_2$ of the recess 18A, recessed more than the first recess 18$A_1$, and forming the second protrusion 18$B_2$ of the protrusion 18B caused to protrude more than the first protrusion 18$B_1$ by the recess of the second recess 18$A_2$. As a result, the recess 18A has the first recess 18$A_1$ recessed by the first pressing portion 112$a_1$ on the first core wire crimping portion 12$A_1$ side and the second recess 18$A_2$ recessed more than the first recess 18$A_1$ by the second pressing portion 112$a_2$ on the second core wire crimping portion 12$A_2$ side (FIG. 22). In addition, the protrusion 18B has the first protrusion 18$B_1$ caused to protrude by the recess of the first recess 18$A_1$ on the first core wire crimping portion 12$A_1$ side and the second protrusion 18$B_2$ caused to protrude more than the first protrusion 18$B_1$ by the recess of the second recess 18$A_2$ on the second core wire crimping portion 12$A_2$ side As described above, the pair of barrel pieces (the first barrel piece 15 and the second barrel piece 16) is wound around the core wire 51 while widening the distance with respect to the bottom 14 in the sandwiching direction of the core wire 51 as being directed from the first core wire crimping portion 12$A_1$ side to the sheath crimping portion 12B side in the second core wire crimping portion 12$A_2$ Thus, regarding the distance between the protrusion 18B in the sandwiching direction of the core wire 51 and the pair of barrel pieces, there is a possibility that a distance between the second protrusion 18$B_2$ and the pair of barrel pieces is larger than a distance between the first protrusion 18$B_1$ and the pair of barrel pieces. Here, however, the second protrusion 18$B_2$ protrudes toward the pair of barrel pieces more than the first protrusion 18$B_1$ in the sandwiching direction of the core wire 51. Accordingly, it is possible to shorten a difference between a distance D1 between the first protrusion 18$B_1$ and the pair of barrel pieces and a distance D2 between the second protrusion 18$B_2$ and the pair of barrel pieces, between the protrusion 18B in the sandwiching direction of the core wire 51 and the pair of barrel pieces (FIG. 22). Therefore, it is possible to suppress variations of the crimping force between the protrusion 18B and the pair of barrel pieces in this case so that it is possible to suppress variations in the amount of adhesion of the core wire crimping portion 12A with respect to the core wire 51.

For example, the arc-shaped parts of the first pressing portion 112$a_1$ and the second pressing portion 112$a_2$ may have the same shape, and the respective arc-shaped parts may have different curvatures. The first pressing portion 112$a_1$ is formed such that the arc-shaped part and the first support surface 112$A_1$ are arranged with an equal distance. In addition, here, the second pressing portion 112$a_2$ is also formed such that the arc-shaped part and the first support surface 112$A_1$ are arranged with an equal distance. At that time, there is a possibility that a part narrower than the distance D1 is generated at the distance D2. However, the convex pressing portion 112*a* can shorten a difference between the distance D1 and the distance D2 even in this case, and thus, it is possible to suppress the variations of the crimping force between the protrusion 18B and the pair of barrel pieces and to suppress the variations in the amount of adhesion of the core wire crimping portion 12A with respect to the core wire 51.

In addition, regarding the second pressing portion 112$a_2$, the protruding amount from the first support surface 112$A_1$ may be gradually increased from the first pressing portion 112$a_1$ side such that the distance with respect to the third wall surface 116*c* of the pressing surface 116 becomes uniform. In this case, it is possible to further shorten the difference between the distance D1 and the distance D2, and thus, it is possible to further suppress the variations of the crimping force between the protrusion 18B and the pair of barrel pieces and to further suppress the variations in the amount of adhesion of the core wire crimping portion 12A with respect to the core wire 51.

In this manner, the terminal-equipped electric wire 50A, the terminal crimping apparatus 100, and the method of manufacturing a terminal-equipped electric wire in this case are provided with the step between the first pressing portion 112$a_1$ and the second pressing portion 112$a_2$ of the convex pressing portion 112*a* as described above, and thus, it is possible to shorten the difference between the distance D1 between the first protrusion 18$B_1$ and the pair of barrel pieces (the first barrel piece 15 and the second barrel piece 16) and the distance D2 between the second protrusion $18B_2$ and the pair of barrel pieces after completion of crimping. Therefore, the terminal-equipped electric wire 50A, the terminal crimping apparatus 100, and the method of manufacturing a terminal-equipped electric wire can suppress the variations of the crimping force between the protrusion 18B and the pair of barrel pieces, and thus, can suppress the variations in the amount of adhesion with respect to the core wire 51. Accordingly, the terminal-equipped electric wire 50A, the terminal crimping apparatus 100, and the method of manufacturing a terminal-equipped electric wire can secure the crimping force of the crimp terminal 1 with respect to the electric wire 50 and make the electrical connection state between the crimp terminal 1 and the electric wire 50 more favorable.

The terminal-equipped electric wire, the terminal crimping apparatus, and the method of manufacturing a terminal-equipped electric wire according to the present embodiment can reduce an elongation amount of a core wire crimping portion after completion of crimping and can reduce an elongation amount of a crimp terminal after completion of crimping while securing a crimping force of the crimp terminal with respect to the electric wire. Since the terminal-equipped electric wire, the terminal crimping apparatus, and the method of manufacturing a terminal-equipped electric wire can reduce the elongation amount of the core wire crimping portion after completion of crimping, it is possible to suppress the sticking-out of the unsupported part of the bottom toward the pressing direction at the time of ending the crimping processing. In this manner, the terminal-equipped electric wire, the terminal crimping apparatus, and the method of manufacturing a terminal-equipped electric wire according to the present invention can suppress the increase in size of the crimp terminal. Further, the terminal-equipped electric wire, the terminal crimping apparatus, and the method of manufacturing a terminal-equipped electric wire can suppress the increase in size of the crimp terminal while securing the crimping force of the crimp terminal with respect to the electric wire to keep an electrical connection state between the crimp terminal and the electric wire at a desired state.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal-equipped electric wire comprising:

an electric wire having a core wire bare at an end thereof; and a crimp terminal physically and electrically connected to the core wire by being crimped to the end of the electric wire, wherein the crimp terminal comprises an electric wire connection portion that has a bottom having a placement surface on an inner wall surface side on which the end of the electric wire is placed and a supported surface on an outer wall surface side, and a pair of barrel pieces that extends from both ends of the bottom in a width direction and is wound around the end of the electric wire, the electric wire connection portion includes a core wire crimping portion in which the bottom and the pair of barrel pieces are crimped to the core wire at the end of the electric wire and a sheath crimping portion in which the bottom and the pair of barrel pieces are crimped to a sheath at the end of the electric wire, the bottom of the core wire crimping portion includes a recess, formed by causing a part of the supported surface to be recessed to the inner wall surface side, and a protrusion formed to protrude from the inner wall surface toward the core wire at the end of the electric wire as the recess is recessed, and ends of the recess and the protrusion on a side opposite to the sheath crimping portion side are inclined to the sheath crimping portion side as being directed from the outer wall surface side to the inner wall surface side.

2. The terminal-equipped electric wire according to claim 1, wherein the recess and the protrusion are extended along a drawing direction of the electric wire from the crimp terminal.

3. The terminal-equipped electric wire according to claim 1, wherein the end of the protrusion on the side opposite to the sheath crimping portion side includes a serration recessed toward the recess.

4. A terminal crimping apparatus comprising:

a first mold that supports a supported surface on an outer wall surface side of a bottom of a crimp terminal having the bottom and a pair of barrel pieces; and a second mold that winds the pair of barrel pieces around an end of an electric wire while shortening a distance with respect to the first mold in a state where the end of the electric wire is inserted into a space surrounded by the bottom and the pair of barrel pieces to form a core wire crimping portion crimped to a core wire bare at the end of the electric wire and a sheath crimping portion crimped to a sheath at the end of the electric wire, wherein the first mold comprises a first support surface supporting the supported surface of the bottom of the core wire crimping portion, a second support surface supporting the supported surface of the bottom of the sheath crimping portion; and a convex pressing portion protruding from the first support surface toward the second mold, the convex pressing portion is inserted into a recess in which a part of the supported surface at the bottom of the core wire crimping portion is recessed to an inner wall surface side of the bottom to press and deform a wall surface of the recess while shortening a distance with respect to the second mold so that a protrusion protruding from the inner wall surface toward the core wire at the end of the electric wire is formed in the bottom of the core wire crimping portion, and an end of the convex pressing portion on a side opposite to the second support surface side is inclined to the second support surface side as being directed toward a protruding direction of the convex pressing portion, and each end of the recess and the protrusion on a side opposite to the sheath crimping portion side is inclined to the sheath crimping portion side as being directed from the outer wall surface side to the inner wall surface side when the recess and the protrusion are formed.

5. A method of manufacturing a terminal-equipped electric wire, the method comprising:

a terminal support step of supporting a supported surface on an outer wall surface side of a bottom of a crimp terminal having the bottom and a pair of barrel pieces using a first mold; and a crimping step of winding the pair of barrel pieces around an end of an electric wire while shortening a distance between the first mold and a second mold in a state where the end of the electric wire is inserted into a space surrounded by the bottom and the pair of barrel pieces to form a core wire crimping portion crimped to the core wire bare at the end of the electric wire and a sheath crimping portion crimped to a sheath at the end of the electric wire, wherein, in the terminal support step, the supported surface of the bottom of the core wire crimping portion is supported by a first support surface of the first mold, the supported surface of the bottom of the sheath crimping portion is supported by a second support surface of the first mold, and a convex pressing portion protruding from the first support surface toward the second mold is inserted into a recess in which a part of the supported surface at the bottom of the core wire crimping portion is recessed to an inner wall surface side of the bottom when the supported surface of the bottom of the core wire crimping portion is supported by the first support surface, in the crimping step, a wall surface of the recess is pressed and deformed by the convex pressing portion while crimping the pair of barrel pieces with respect to the end of the electric wire to form a protrusion protruding from the inner wall surface toward the core wire at the end of the electric wire in the bottom of the core wire crimping portion, and in the crimping step, each end of the recess and the protrusion on a side opposite to the sheath crimping portion side is inclined to the sheath crimping portion side as being directed from the outer wall surface side to the inner wall surface side by pressing a wall surface of the recess with the convex pressing portion having an end on a side opposite to the second support surface side inclined to the second support surface side as being directed toward a protruding direction of the convex pressing portion when the recess and the protrusion are formed.

* * * * *